US009713357B2

(12) United States Patent
Denison et al.

(10) Patent No.: US 9,713,357 B2
(45) Date of Patent: Jul. 25, 2017

(54) ASYMMETRIC SHOES

(71) Applicant: TAYLOR MADE GOLF COMPANY, INC., Carlsbad, CA (US)

(72) Inventors: Masun Denison, Carlsbad, CA (US); Michael Hesterberg, Carlsbad, CA (US); Dylan Moore, Encinitas, CA (US)

(73) Assignee: TAYLOR MADE GOLF COMPANY, INC., Carlsbad, CA (US)

( * ) Notice: Subject to any disclaimer, the term of this patent is extended or adjusted under 35 U.S.C. 154(b) by 0 days.

(21) Appl. No.: 14/594,995

(22) Filed: Jan. 12, 2015

(65) Prior Publication Data

US 2016/0015120 A1 Jan. 21, 2016

Related U.S. Application Data

(60) Provisional application No. 62/024,894, filed on Jul. 15, 2014.

(51) Int. Cl.
*A43B 5/00* (2006.01)
*A43B 3/00* (2006.01)
(Continued)

(52) U.S. Cl.
CPC ..... *A43B 5/001* (2013.01); *A43B 3/0094* (2013.01); *A43B 5/06* (2013.01); *A43B 7/14* (2013.01); *A43C 15/16* (2013.01)

(58) Field of Classification Search
CPC ..... A43B 3/0094; A43B 5/06; A43B 7/14; A43B 7/18; A43B 23/0235; A43B 23/0265
(Continued)

(56) References Cited

U.S. PATENT DOCUMENTS 4,149,324 A 4/1979 Lesser et al.
4,527,345 A 7/1985 Lopez
(Continued)

FOREIGN PATENT DOCUMENTS

JP 2005 021384 A 1/2005
JP 2012 139348 A 7/2012

OTHER PUBLICATIONS

Translation of JP 2012-139348, Goto, H, Nakamura, A, Sole for Golf Shoes and Golf Shoes Using the Same, JP 2012-139348, Jul. 26, 2012, translated by Google translation on Feb. 5, 2016.*
(Continued)

*Primary Examiner* — Clinton T Ostrup
*Assistant Examiner* — Heather Mangine
(74) *Attorney, Agent, or Firm* — Duane Morris LLP

(57) ABSTRACT

An asymmetric pair of shoes to optimize performance during a sporting activity, the asymmetric pair of shoes, including: a first shoe having a first upper and a first sole attached to the first upper, wherein the first upper comprises a first support feature configured to provide increased support to at least one portion of the first upper during performance of a first predetermined action of a first foot of a wearer, and the first sole comprises a first traction feature configured to provide increased traction to at least one portion of the first sole during performance of the first predetermined action of the first foot; and a second shoe having a second upper and a second sole attached to the second upper, wherein the first support feature and first traction feature are not present at corresponding mirror-image locations of the second shoe.

59 Claims, 12 Drawing Sheets

(51) Int. Cl.
*A43B 5/06* (2006.01)
*A43B 7/14* (2006.01)
*A43C 15/16* (2006.01)

(58) Field of Classification Search
USPC ..... 36/127
See application file for complete search history.

(56) References Cited

U.S. PATENT DOCUMENTS

| | | | | |
|---|---|---|---|---|
| 7,950,112 | B2 | 5/2011 | Hammerslag et al. | |
| 8,381,362 | B2 | 2/2013 | Hammerslag et al. | |
| 8,468,657 | B2 | 6/2013 | Soderberg et al. | |
| 8,516,662 | B2 | 8/2013 | Goodman et al. | |
| 2007/0199213 | A1 | 8/2007 | Campbell et al. | |
| 2007/0240337 | A1* | 10/2007 | Belluto | A43B 3/0042 36/134 |
| 2010/0047550 | A1 | 2/2010 | Prissok et al. | |
| 2010/0222442 | A1 | 9/2010 | Prissok et al. | |
| 2010/0229426 | A1* | 9/2010 | Brown | A43B 1/04 36/129 |
| 2011/0088287 | A1* | 4/2011 | Auger | A43B 5/02 36/107 |
| 2012/0065285 | A1 | 3/2012 | Braun et al. | |
| 2012/0174433 | A1* | 7/2012 | Mahoney | A43B 7/1425 36/28 |
| 2013/0092780 | A1 | 4/2013 | Soderberg et al. | |
| 2013/0291409 | A1 | 11/2013 | Reinhardt et al. | |
| 2014/0123449 | A1 | 5/2014 | Soderberg et al. | |
| 2014/0208550 | A1 | 7/2014 | Neiley | |
| 2015/0351492 | A1* | 12/2015 | Dombrow | A43B 13/122 36/102 |

OTHER PUBLICATIONS

New translation of JP 2012139348, Goto, Hiromichi et al. Aug. 26, 2012. Translated Jun. 2016 by Schreiber Translations, Inc.*

Extended European Search Report in European Patent Application No. 15176451.1, dated Dec. 10, 2015, in 8 pages.

* cited by examiner

ASYMMETRIC SHOES

RELATED PATENT APPLICATIONS

This application claims benefit of priority under 35 U.S.C. §119(e) to Provisional Application No. 62/024,894, entitled "ASYMMETRIC SHOES," filed Jul. 15, 2014, which is incorporated by reference herein in its entirety.

FIELD OF THE INVENTION

The invention is generally related to shoes used during sporting activities and, more particularly, to asymmetric shoes having different left and right shoe designs and features for optimizing performance and other characteristics of each shoe based on different anticipated movements of the left and right feet of an athlete during a particular sporting activity (e.g., golf).

BACKGROUND OF THE INVENTION

Many sporting activities today require repeatedly performing actions in a predetermined manner, which require different movements of a player's left and right feet. For example, in golf, the golfer's footwork during the swing is complex and differs between left and right feet. In general, for most golf shots the golfer's weight is initially loaded 50/50 on each foot and the golfer's weight is typically distributed evenly across the bottom surface area of each foot. During the backswing, a majority of the golfer's weight typically shifts to the outside (lateral side) of the golfer's back foot while the front foot maintains some weight for balance. The backswing applies forces tending to spin or pivot the back forefoot outwardly and the back heel inwardly, which must be resisted by the back foot's contact with the ground to keep the golfer's back foot stable.

During the downswing of the club, the golfer's weight begins to shift and by the time the golf ball is struck, the golfer's weight is again evenly distributed between the rear and front feet, or has started to shift more to the front foot. At the finish position of the swing, most of the golfer's weight is on the front foot with more weight on the outside (lateral side) of the front foot than the inside (medial side), and the golfer's heel and shoe outsole of the back foot are elevated above the ground and face rearwardly. In a proper swing, only the toe portion of the golfer's rear foot remains in contact with the ground at the finish. In the finish position, the heel and most of the outsole of the golfer's rear shoe are off of the ground, with only the toe portion contacting the ground for balance.

As discussed above, the golfer's feet make complex movements during a golf swing to keep the golfer balanced while generating torque and club head speed to strike the golf ball. During various stages of the golf swing, different forces, pressures and stresses are exerted on the left and right shoes, which require each shoe to perform and react in different ways. Similar circumstances exist during other sports such as baseball (e.g., during a batter's swing) and track & field (e.g., during start and running in a counter-clockwise direction on a track). Conventional shoes used during these types of sporting activities, however, are generally symmetrically designed and do not distinguish between different left and right foot actions and movements that may require different functionality, features and structures in the left and right shoes to optimize their performance during the sporting activity.

Additionally, in conventional golf shoes, the outsole includes a rigid base platform that supports various traction elements in way that provides very little independent movements between the traction elements. Typically, the outsole moves as a rigid unit such that when the heel lifts or the foot tilts to the side, a majority of the sole lifts off the ground and loses traction, leaving only the toe or a side edge in contact with the ground for traction. Furthermore, in conventional golf shoes, the sole lacks cushioning or flexibility to promote smooth energy transfer between the ground and the golfer's feet during the golf swing. The relatively rigid soles of conventional golf shoes can also be uncomfortable to a golfer compared to other types of athletic shoes.

SUMMARY OF THE INVENTION

The invention addresses the above deficiencies of conventional shoes by providing asymmetric shoes having different features, structures and characteristics between left and right shoes to optimize the performance of each shoe during a particular sporting activity. Although various exemplary embodiments of the invention are described herein in the context of golf, one of ordinary skill in the art will appreciate that various features and concepts discussed herein can be applied to shoes used during any sporting activity that repeatedly requires different movements and actions between the left and right feet of a player. Additionally, exemplary asymmetric shoes are described herein for a right-handed golfer for whom the left foot would be the front foot during a golf swing and the right foot would be the rear or back foot during the golf swing. One of ordinary skill in the art will recognize that for left-handed golfers, the right foot would be the front foot and the left foot the back foot during a golf swing. Thus, the features and designs of the asymmetric shoes would be switched from the left shoe to the right shoe, and vice versa, for such left-handed golfers when compared to right-handed golfers.

In one embodiment of the invention, an asymmetric pair of shoes includes: a first shoe having a first upper and a first sole attached to the first upper, wherein the first upper comprises a first support feature configured to provide increased support to at least one portion of the first upper during performance of a first predetermined action of a first foot of a wearer, and the first sole comprises a first traction feature configured to provide increased traction to at least one portion of the first sole during performance of the first predetermined action of the first foot; and a second shoe having a second upper and a second sole attached to the second upper, wherein the first support feature and first traction feature are not present at corresponding mirror-image locations of the second shoe.

In another embodiment, an asymmetric pair of golf shoes, includes: a first shoe having a first upper and a first sole attached to the first upper, wherein the first upper comprises a first support feature configured to provide increased support to at least one portion of the first upper during performance of a forward swing motion of a golf swing, and the first sole comprises a first traction feature configured to provide increased traction to at least one portion of the first sole during performance of the forward swing motion; and a second shoe having a second upper and a second sole attached to the second upper, wherein the second upper comprises a second support feature configured to provide increased support to at least one portion of the second upper during performance of a backswing motion of a golf swing, and the second sole comprises a second traction feature configured to provide increased traction to at least one portion of the second sole during performance of the backswing motion, wherein the first support feature and first traction feature are not present at corresponding mirror-image locations of the second shoe, and the second support feature and the second traction feature are not present at corresponding mirror-image locations of the first shoe.

Further features and advantages of the present invention, as well as the structure and operation of various embodiments of the present invention, are described in detail below with reference to the accompanying drawings.

BRIEF DESCRIPTION OF THE DRAWINGS

In the following description of exemplary embodiments, reference is made to the following Figures which form a part hereof, and in which it is shown by way of illustration specific embodiments in which the invention may be made and practiced. It is to be understood that other embodiments may be utilized, and design and/or structural changes may be made, without departing from the scope of the invention. The Figures are provided for purposes of illustration only and merely depict exemplary embodiments of the invention to facilitate the reader's understanding of the invention and should not be considered limiting of the breadth, scope, or applicability of the invention. It should be noted that for clarity and ease of illustration these drawings are not necessarily drawn to scale.

DETAILED DESCRIPTION OF EXEMPLARY EMBODIMENTS OF THE INVENTION

In the following description of exemplary embodiments, reference is made to the accompanying drawings which form a part hereof, and in which it is shown by way of illustration of specific embodiments in which the invention may be practiced. It is to be understood that other embodiments may be utilized and structural changes may be made without departing from the scope of the invention. Although various embodiments and features of the invention are described below in the context of golf shoes, it will be apparent to those of ordinary skill in the art that various features and advantages of the invention can be applied to shoes used during other types of sporting activities that require or promote different left and right foot actions.

As any golfer knows, power and consistency is the "name of the game." By designing left and right shoes to take into account the different forces applied to the front and back feet during a swing, in one embodiment, the invention optimizes the performance and characteristics of each shoe for respective front and back foot actions and movement during the swing.

FIGS. 1A-1D illustrate vertical force distributions on the left and right feet of a right-handed golfer during various exemplary stages of the golf swing. These figures also illustrate, generally, how the front and back feet move during the golf swing, which results in the different vertical forces shown for each foot. Bar graphs presented between the left and right feet in each figure graphically represent the relative force distribution on each foot during different stage of the golf swing. Additionally, the intensity or density of shading on each foot represents, generally, typical vertical forces exerted on different portions of each foot during different stages of the golf swing.

Figure 1A:
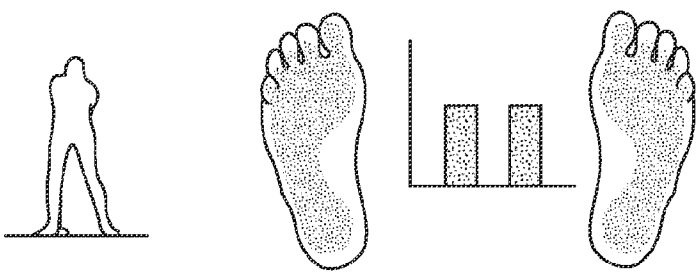
FIGS. 1A-1D illustrate exemplary top-down through-views of vertical force intensities on the front and back feet of a golfer during various stages of the golf swing.
Figure 1B:
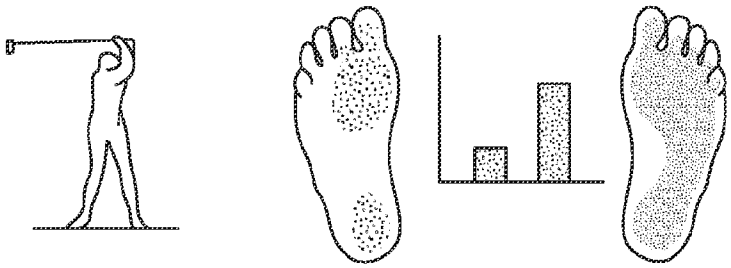
Figure 1C:
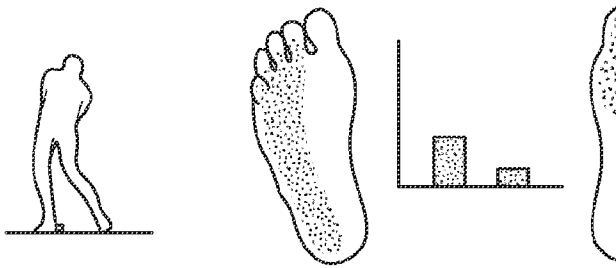
Figure 1D:
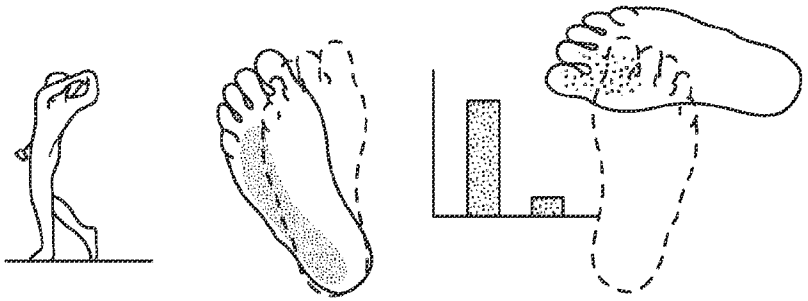

As shown in FIG. 1A, at the beginning of the golf swing when the golfer is addressing the golf ball, the golfer's weight is typically evenly distributed on both front (left) and back (right) feet, which results in an even distribution of vertical forces applied across the majority of the bottom surface area of each foot. As shown in FIG. 1B, when the golfer has reached the top of the backswing, the majority of his weight, and hence the majority of vertical forces, shifts to his back foot. As the golfer begins his downswing, his weight will start shifting again to his front foot and when the club head impacts the golf ball, the majority of his weight, and hence vertical forces, shifts to the front foot, as shown in FIG. 1C. At the end of the swing approximately 80% or more of the golfer's weight has shifted to the lateral edge portions of his front foot with only a small portion of his weight supported by the big toe portion of his rear foot, as shown in FIG. 1D.

In addition to vertical forces discussed above, different directional horizontal forces act upon the golfer's front and back feet during different stages of the golf swing and the transitions between these stages. FIGS. 2A-2D illustrate typical directional horizontal forces that are exerted on a golfer's front and back feet during different exemplary stages of the golf swing, where the arrow heads indicate the direction of the horizontal force and the shading intensities of the arrow heads indicate the relative strength of such horizontal forces (the darker the shading the stronger the force).

Figure 2B:
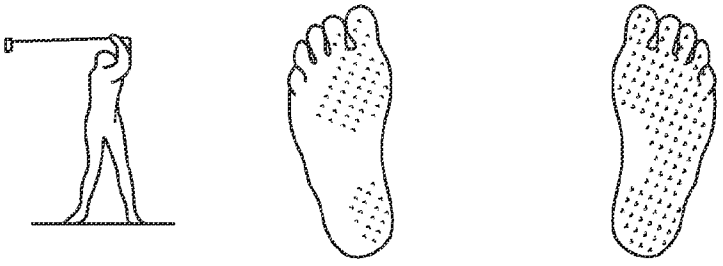
FIGS. 2A-2D illustrate exemplary top-down through-views of directional horizontal forces exerted on the front and back feet of a golfer during various stages of the golf swing.
Figure 2A:
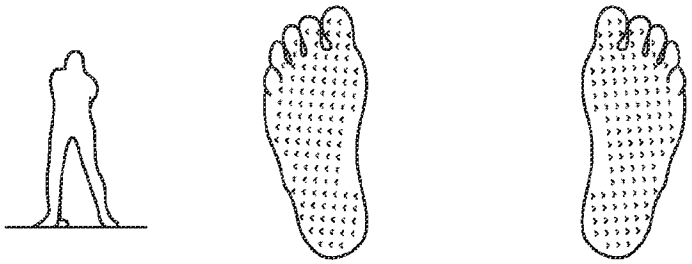
Figure 2D:
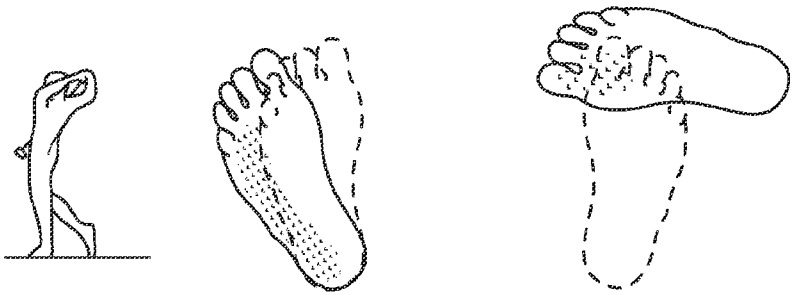
Figure 2C:
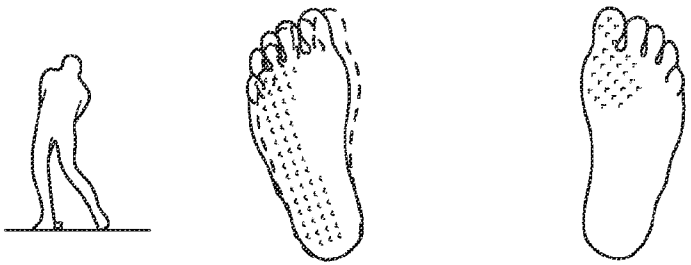

As shown in FIG. 2A, at the beginning of the swing when the golfer is addressing the golf ball, his weight is typically evenly distributed on both feet and the directional horizontal forces exerted on both feet are generally in the lateral (outward) direction on both feet. As shown in FIG. 2B, when the golfer has reached the top of the backswing, the majority of his weight shifts to his back (right) foot and the directional horizontal forces on the rear foot are in a lateral and slightly rearward (i.e., downward angle on the page) direction with respect to the back foot. As the golfer begins his downswing, his weight will start shifting again back to his front foot and when the club head impacts the golf ball, the majority of his weight shifts to the front foot and the directional forces on the front foot are in a lateral and slightly rearward direction with respect to the front foot, as shown in FIG. 2C. At the end of the swing approximately 80% or more of the golfer's weight has shifted to the lateral edge portions of his front foot with only a small portion of his weight supported by the big toe portion of his rear foot. At this point in the swing, only a relatively small amount of directional horizontal forces in a lateral and rearward direction are exerted on the front foot, as shown in FIG. 2D.

Figure 3A:
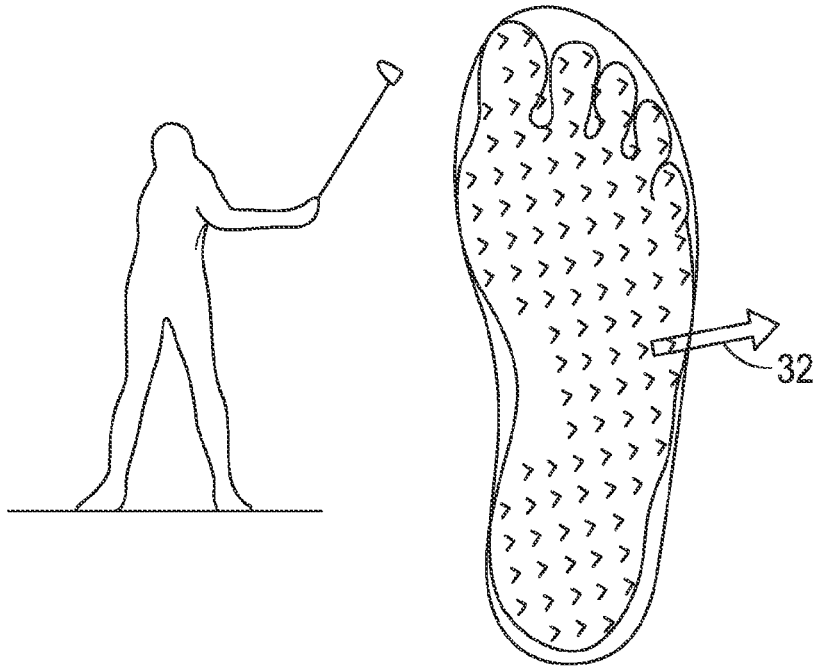
FIGS. 3A and 3B illustrate exemplary top-down through-views of directional horizontal forces exerted on a golfer's back foot during two intermediates stages of the golfer's backward swing, respectively.
Figure 3B:
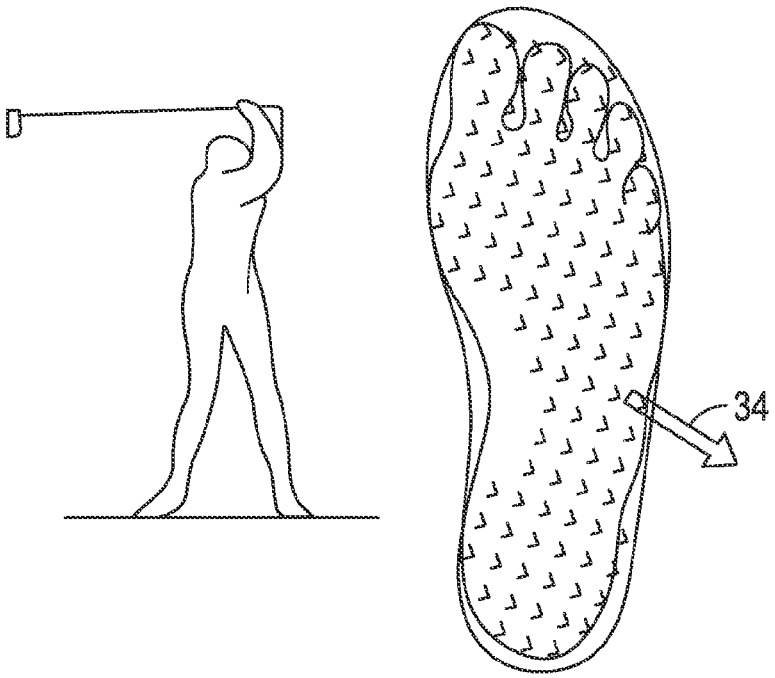

FIGS. 3A and 3B illustrate different directional horizontal forces exerted on the back foot at an intermediate transition stage during the back swing and the top of the back swing, respectively. As these figures illustrate, the direction of the horizontal forces changes from a lateral, slightly forward direction as indicated by arrow 32 in FIG. 3A, to a lateral, slightly rearward direction as indicated by arrow 34 in FIG. 3B. In one embodiment of the invention, described in further detail below, the traction elements of the back shoe compensate for these horizontal directional forces exerted during the back swing to optimize its performance during the back swing.

Figure 4A:
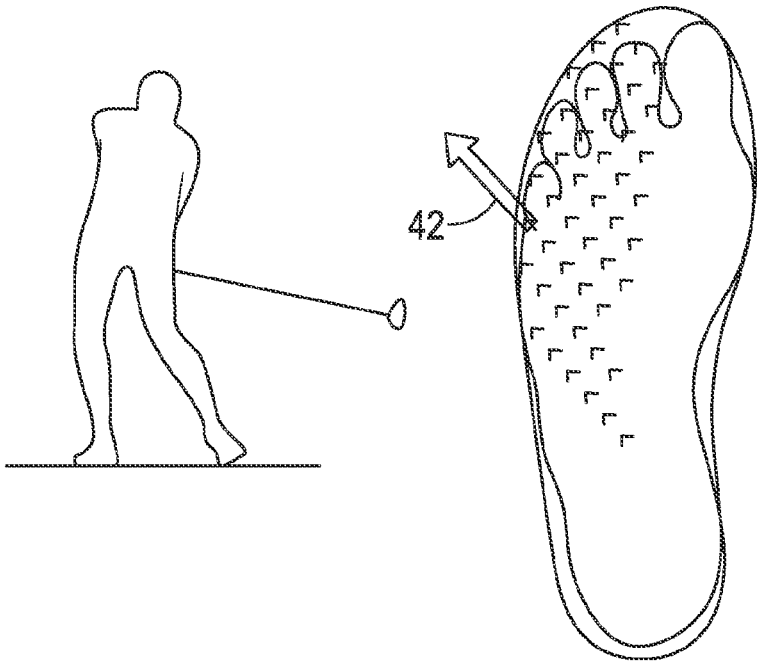
FIGS. 4A and 4B illustrate exemplary top-down through-views of directional horizontal forces exerted on a golfer's front foot during two intermediates stages of the golfer's forward swing, respectively.
Figure 4B:
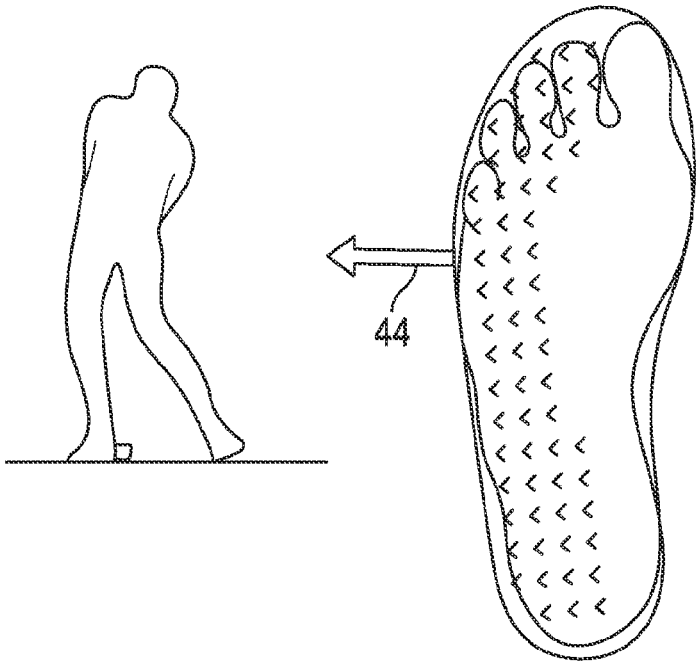

FIGS. 4A and 4B illustrate different directional horizontal forces exerted on the front foot at an intermediate transition stage during the forward swing and at impact with the golf ball, respectively. As these figures illustrate, the direction of the horizontal forces changes from a lateral, slightly forward direction as indicated by arrow 42 in FIG. 4A, to a substantially lateral direction at impact as indicated by arrow 44 in FIG. 4B. In one embodiment of the invention, described in further detail below, the traction elements of the front shoe compensate for these horizontal directional forces exerted during the forward swing to optimize its performance during the forward swing.

As indicated by the exemplary FIGS. 1A-4B discussed above, the front and back feet perform differently during a golf swing, requiring different traction, support, flexibility, balance and stability characteristics for each shoe, these factors not being mutually exclusive.

Figure 5A:
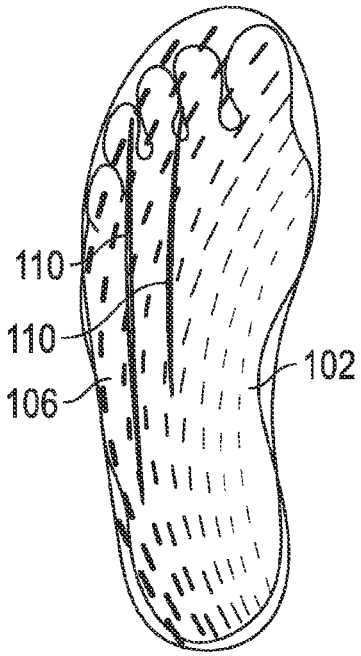
FIGS. 5A and 5B illustrate exemplary top-down through-views of directional traction and groove elements that may be incorporated into front and back golf shoes, respectively, in accordance with one embodiment of the invention.
Figure 5B:
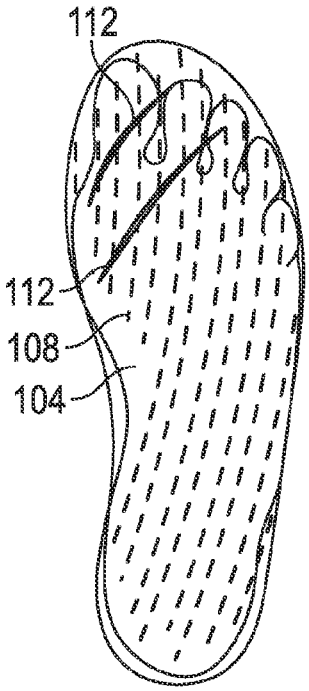

FIGS. 5A and 5B show top-down through views of the bottom soles 102 and 104 of left and right shoes, respectively, having asymmetric directional traction elements 106 and 108, respectively, in accordance with one embodiment of the invention. For purposes of discussion and illustration, the directional traction elements 106 and 108 are illustrated as relatively small line segments to represent that the traction elements are configured to resist movement or sliding at least in a direction that is perpendicular to each line segment. As would be understood by persons of ordinary skill in the art, the actual number, shape and size of the directional traction elements 106 and 108 need not necessarily resemble the line segments shown in FIGS. 5A and 5B but, rather, may be in various desired shapes, sizes and configurations to achieve various desired gripping characteristics (e.g., resist skidding in one or more directions).

Additionally, the depth or effectiveness of the various directional traction elements 106 and 108 may be varied to achieve desired traction characteristics. For example, as shown in FIG. 5A, the shading intensity of the directional traction elements 106 decreases as one moves from the lateral side of the bottom sole 102 to the medial side of the sole 102, which represents that the depth or effectiveness of directional traction elements 106 is greater at the lateral side of the sole 102 and decreases toward the medial side of the sole 102. As discussed in further detail below, larger and/or deeper traction elements (e.g., cleats, spikes, etc.) may be employed to achieve more effective traction, and smaller and/or shallower traction elements may be employed to achieve less effective traction where desired. Various sizes, shapes and configurations of traction elements may be employed to achieve desired characteristics, in accordance with various embodiments of the invention.

FIG. 5A further illustrate a pair of longitudinal grooves or channels 110 running along and proximate to a lateral edge of the left sole 102. The longitudinal grooves 110 facilitate bending of the sole along the grooves during the golf swing, for example. During the finishing stages of the swing the longitudinal grooves 110 facilitate bending of the left sole such that the outer left edge portions of the sole can more easily remain in contact with the ground as the left (front) foot rolls laterally and the medial portion, or in-step of the shoe, rises above the ground during the finishing segments of the golf swing, thereby providing increased traction at the end of the swing. Although FIG. 5A illustrates two longitudinal grooves 110, in alternative embodiments, one, three or more longitudinal grooves may be implemented to facilitate various desired performance characteristics to take into account various anticipated foot actions that occur during a sporting activity. In addition to varying the number, the location, length, width and/or depth of the longitudinal grooves may also be varied to optimize shoe performance by facilitating proper foot actions that typically occur during a particular sporting activity (e.g., golf).

Similarly, as shown in FIG. 5B, the right sole 104 includes one or more diagonal grooves or channels 112 located proximate to the toe portion of the shoe to enable or facilitate bending of the sole along the grooves at the end of the swing, when the heel of the golfer's right (back) foot is raised and supported by the toe portion of the right shoe. Thus, during the finishing stages of the swing the lateral grooves facilitate bending of the right sole such that the inner toe portions of the sole can more easily remain in contact with the ground as the right heel is raised during the finishing segments of the golf swing, thereby providing increased traction at the end of the swing. Thus, the exemplary grooves on the bottom soles of each shoe which are different between left and right shoes, enable or facilitate the different movements of the left and right feet during the golf swing.

Figure 6A:
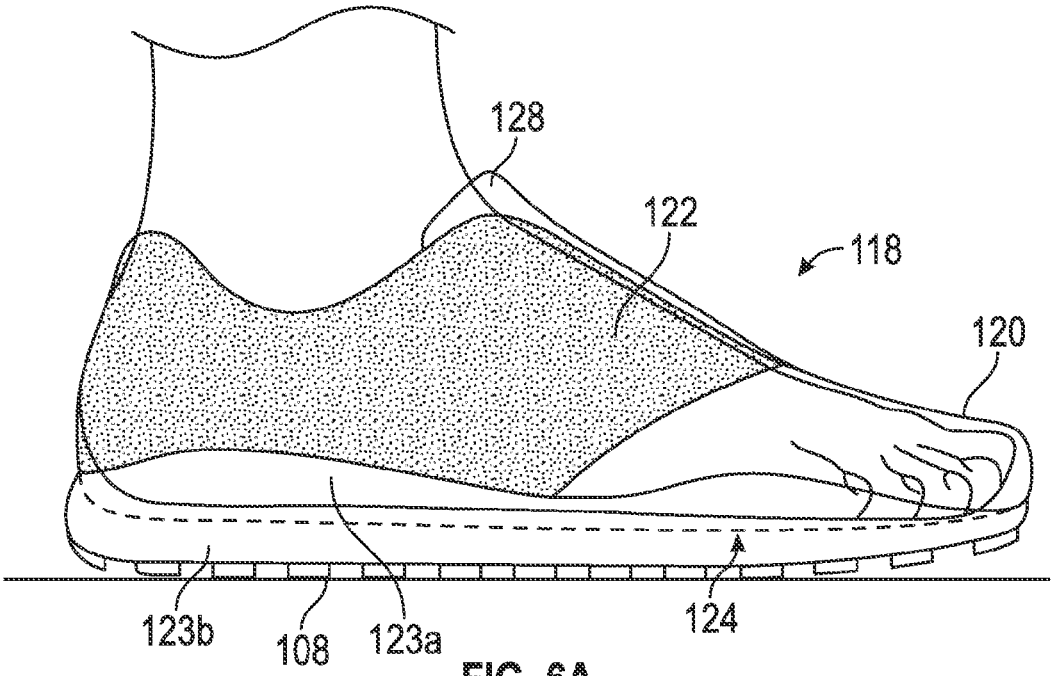
FIGS. 6A and 6B illustrate exemplary side and top views, respectively, of various features of a golfer's back (right) shoe, with some areas or features illustrated transparently for purposes of illustration, in accordance with one embodiment of the invention.
Figure 6B:
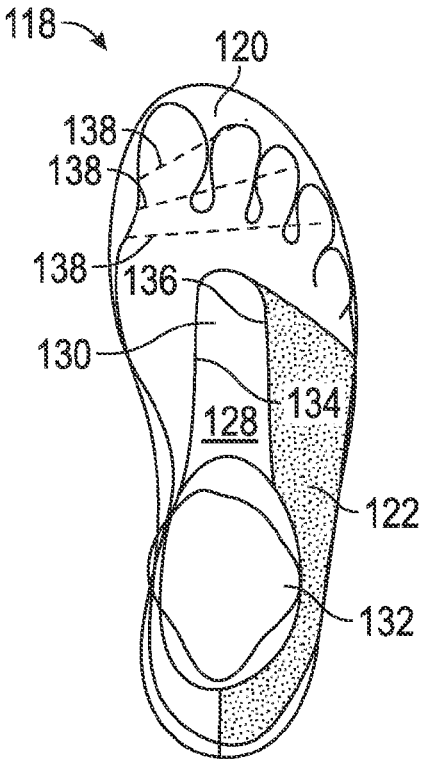

FIGS. 6A and 6B illustrate perspective views of the back (e.g., right) shoe 118 having an upper portion 120 that includes different zones to provide different levels of support and/or flexibility to improve performance of the shoe during a golf swing, in accordance with one embodiment of the invention. The shaded area 122 corresponds to an enhanced support zone 122 located at a lateral middle to heel portion of the upper 120 and is designed to provide greater support and flexibility because of increased outward pressure and forces exerted in that area of the upper during the backswing. Increased support and flexibility in this area of the upper results in greater stability and comfort during the backswing. Various techniques for increasing support and flexibility in this area may be implemented. In one embodiment, the enhanced support zone 122 is provided by utilizing a saddle and/or an extended heel counter in respective areas of the support zone 122, as described in further detail below. Alternatively, in other embodiments, the enhanced support zone 122 may be implemented by increasing the thickness of the upper material (e.g., a breathable leather) in the support zone 122 and/or utilizing different materials or combinations of materials that provide desired support and flexibility properties. In one embodiment, the remaining un-shaded portions of the upper 120 are areas that provide less support and/or flexibility than the enhanced support zone 122.

As shown in FIG. 6A, the shoe 118 further includes a sole 123 comprising a midsole 123*a* and an outsole 123*b*. An exemplary demarcation line 124 between the midsole 123*a* and outsole 123*b* is shown as a dashed line in FIG. 6A. In various embodiments, the midsole 123*a* and outsole 123*b* may be made from different materials and/or have different material properties and characteristics to provide desired performance and/or comfort characteristics. A plurality of traction elements 108 are attached to and extend outwardly from a bottom surface of the outsole 123*b*. The upper 120 further includes a flexible tongue 128 that covers and provides a cushion to a top portion of a wearer's foot after it has been inserted into the shoe 118.

As shown in FIG. 6B, the back shoe also includes a traditional closure 130 located on a top portion of the upper 120 approximately midway between the lateral and medial edges of the upper portion, which is a traditional closure location. The tongue 128 is part of the closure 130 and provides a cushion on top of the wearer's foot against shoe laces (not shown) or other securing means used to tighten and secure the closure 130 around the wearer's foot after it has been inserted into the shoe 118 through a top entry hole 132. In one embodiment, the closure 130 may be tightened and secured around the wearer's foot by traditional shoe laces (not shown) that may be inserted through reinforced lace holes (not shown) located along opposing lips or edge portions 134 and 136 of the closure 130. In alternative embodiments, instead of traditional laces, a reel based lacing system may be incorporated to tighten and secure the closure 130 around the wearer's foot. Examples of reel based lacing systems, and similar systems, are disclosed, for example, in U.S. Pat. No. 7,950,112 B2, U.S. Pat. No. 8,381,362 B2, U.S. Pat. No. 8,468,657 B2, U.S. Pat. No. 8,516,662 B2, U.S. Publication No. 2013/0092780 A1, U.S. Publication No. 2014/0123449 A1 and U.S. Publication No. 2014/0208550 A1, all assigned to Boa Technologies, Inc. of Denver, Colo., U.S.A., and each of which are incorporated by reference herein in their entireties. As further illustrated in FIG. 6B, the upper 120 includes a toe flex zone 138 designed to be more flexible when compared to other areas of the upper 120 to promote and facilitate bending and flexion along the dashed lines, for example, in the toe flex zone 138 as the golfer's right heel is raised during the finishing stages of the golf swing.

Figure 7A:
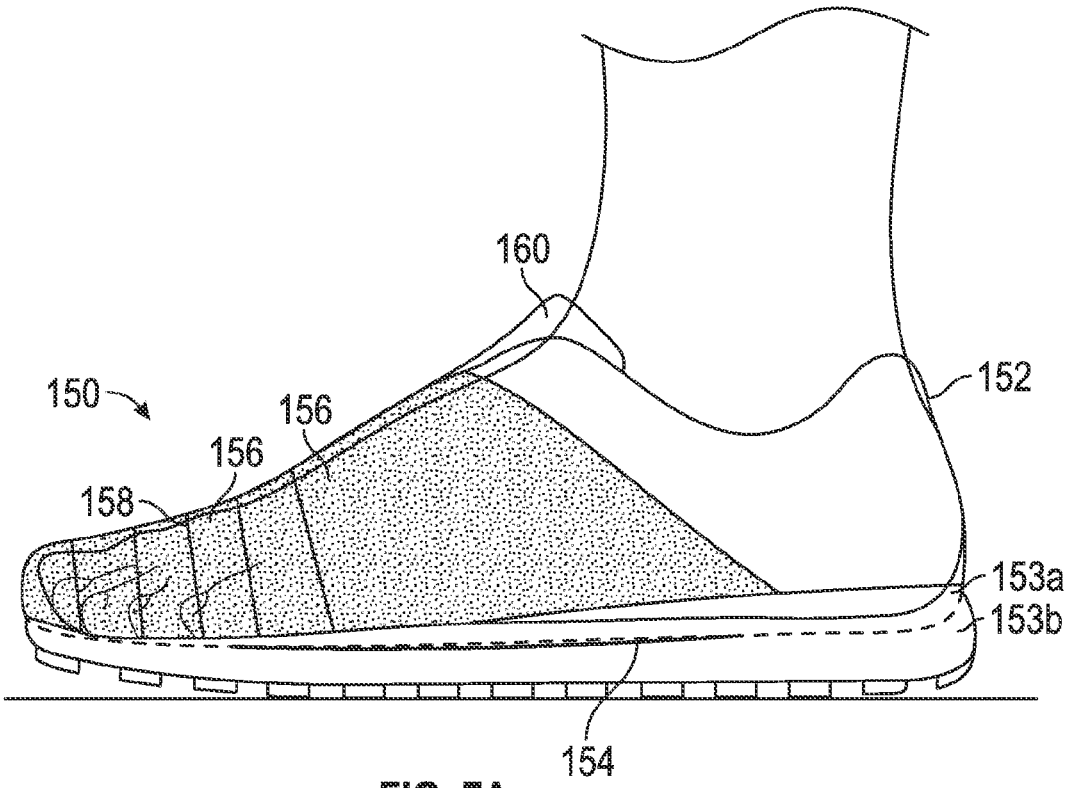
FIGS. 7A and 7B illustrate exemplary side and top views, respectively, of various features of a golfer's front (left) shoe, with some areas or features illustrated transparently for purposes of illustration, in accordance with one embodiment of the invention.
Figure 7B:
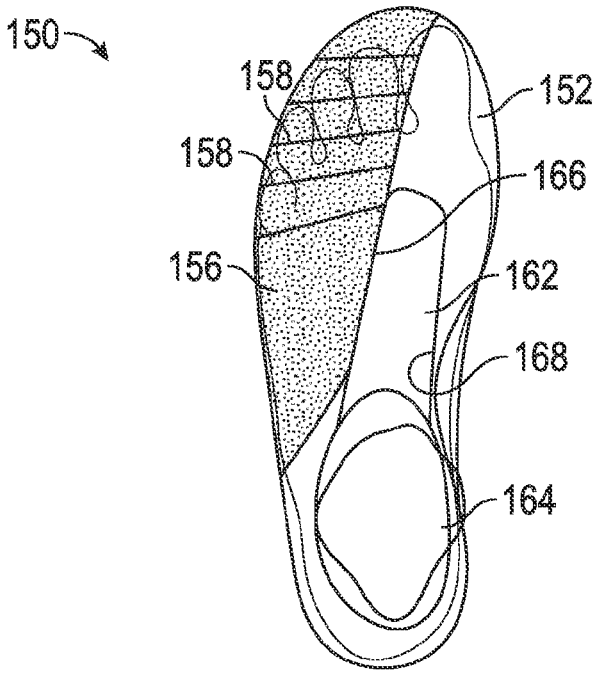

FIGS. 7A and 7B illustrate perspective views of the front (e.g., left) shoe 150 having an upper portion 152 that includes different zones to provide different levels of support and/or flexibility to improve performance of the shoe during a golf swing, in accordance with one embodiment of the invention. The front shoe 150 further includes a sole 153 comprising a midsole portion 153*a* and an outsole portion 153*b* each of which can be made from various known materials to provide desired physical characteristics. Exemplary materials for the midsole 153*a* and outsole 153*b* are described in further detail below. The boundary between the midsole 153*a* and the outsole 153*b* is shown as an exemplary dashed line in FIG. 7A, in accordance with one embodiment of the invention. In a further embodiment, a longitudinal groove or channel 154 is provided along a lateral exterior surface between the midsole 153*a* and outsole 153*b*. The longitudinal groove 154 facilitates a lateral rolling action of the front foot as the midsole 153*a* and 153*b* are compressed together during the finishing stages of the golf swing.

As shown in FIG. 7A, the upper 152 includes an enhanced support zone 156 (illustrated as a shaded area 156) located at a lateral middle to forefoot portion of the upper 152. This support zone 156 is designed to provide greater support and flexibility because of increased outward pressure and forces exerted in that area of the upper during the forward swing and follow-through stages of the golf swing. Increased support and flexibility in this area of the upper results in greater stability and comfort during the forward swing and follow through. Various techniques for increasing support and flexibility in this area may be implemented. In one embodiment, the increased support zone 156 is provided by a saddle and/or an energy sling in respective areas of the support zone 156, as described in further detail below. In alternative embodiments, the increased support zone 156 may be provided by increasing the thickness of material (e.g., a breathable leather) in the support zone 156 and/or utilizing different materials or combinations or materials having desired support and flexibility characteristics in the support zone 156. In one embodiment, the remaining un-shaded areas of the upper 152 require less support and flexibility.

The upper 152 further includes a flex zone 158 generally indicated by the area in which lines 158 are present, since the lines 158 represent potential or exemplary bending portions of the upper 152 that may occur as a result of normal walking and/or playing golf. As discussed in further detail below, one or more grooves placed on the outsole 153*b* facilitate bending of the outsole 153*b*, and hence the upper 152 in the flex zone 158 during normal walking and/or playing golf. The upper 152 further includes a flexible tongue 160 for covering and providing a cushion to a top portion of a wearer's foot that has been inserted into the shoe 150. The tongue 160 is part of an asymmetric closure 162 located on a top of the upper 152 as shown in FIG. 6B.

In contrast to FIG. 6B, FIG. 7B illustrates that the front shoe includes a modified location for the asymmetric closure 162 on the upper 152 such that it is moved closer to the medial area of the upper and angled toward the medial side as it moves away from the shoe opening 164. In this way, the area of the support zone 156 can be increased or maximized to provide increased support and flexibility in the support zone 156. In one embodiment, the support zone 156 of the front shoe 150 is designed to provide increased support and flexibility to optimize performance during the golf swing and comfort during walking.

The tongue 160 is part of the asymmetric closure 162 and provides a cushion on top of the wearer's foot against shoe laces (not shown) or other securing means used to tighten and secure the closure 162 around the wearer's foot after it has been inserted into the shoe 150. In one embodiment, the asymmetric closure 162 may be tightened and secured around the wearer's foot by traditional shoe laces (not shown) that may be inserted through reinforced lace holes (not shown) located along opposing lips or edge portions 166 and 168 of the asymmetric closure 162. In alternative embodiments, instead of traditional laces, a reel based lacing system, or similar systems, may be incorporated to tighten and secure the asymmetric closure 162 around the wearer's foot, as discussed above in connection with FIG. 6B.

Figure 8A:
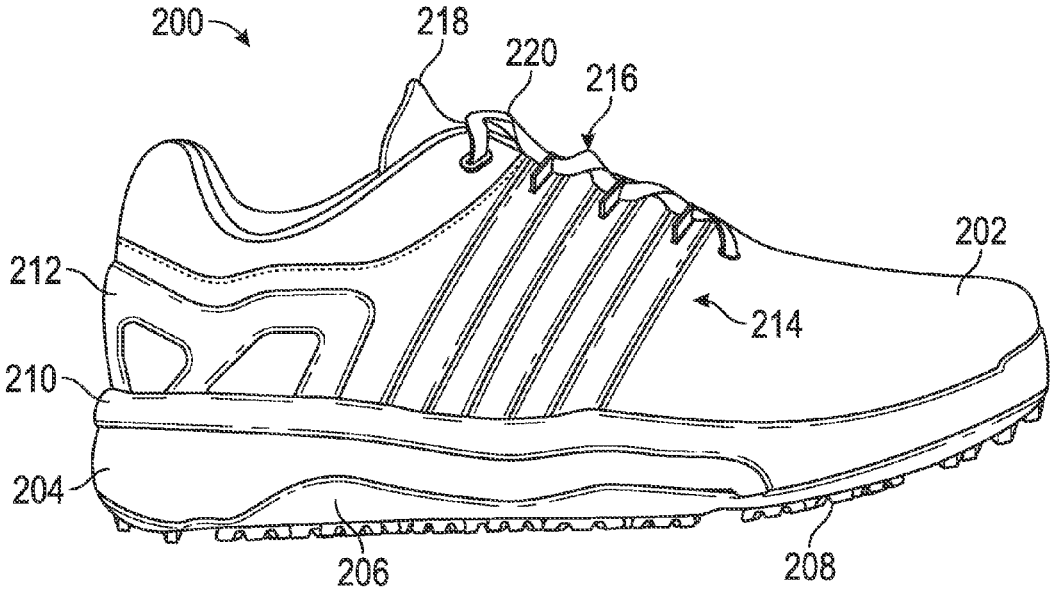
FIGS. 8A and 8B illustrate perspective side views, lateral (outer-step) and medial (in-step) views, respectively, of a back (right) shoe, in accordance with one embodiment of the invention.
Figure 8B:
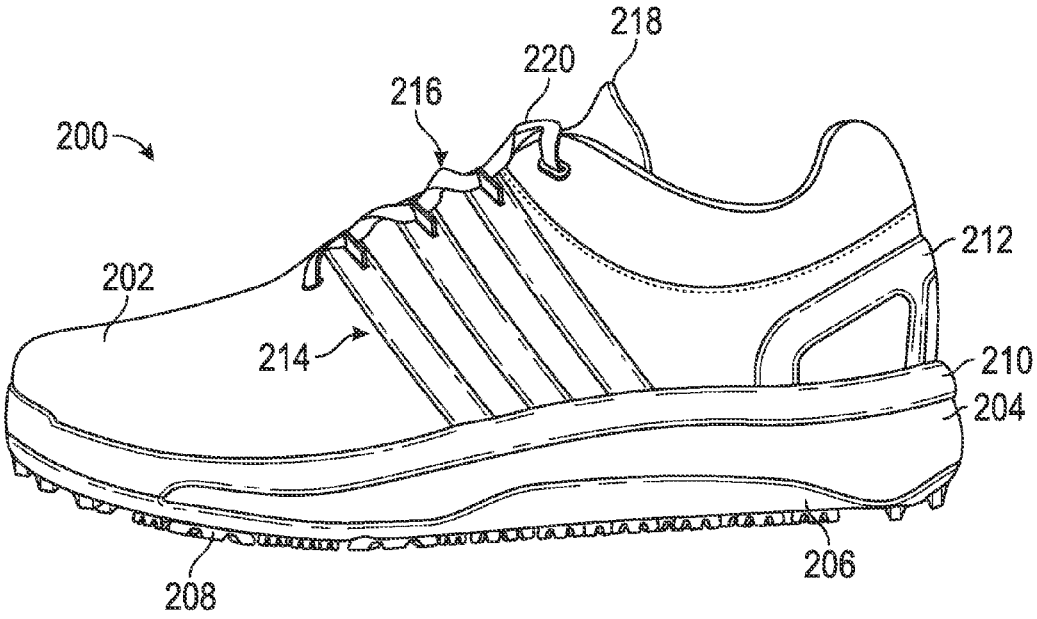

FIGS. 8A and 8B illustrate perspective side lateral and medial views, respectively, of a back (in this case, right) shoe 200, in accordance with one embodiment of the invention. As discussed in further detail herein, the back shoe 200 has a plurality of design features that are different (i.e., asymmetric) with respect to a corresponding front shoe 300, discussed in further detail with respect to FIGS. 9A and 9B below. As shown in FIG. 8A, the back shoe 200 includes an upper 202, a midsole 204 attached to a bottom portion of the upper 202, and an outsole 206 attached to a bottom portion of the midsole 204 such that the midsole 204 is sandwiched between the upper 202 and the outsole 206. A plurality of traction elements 208 extend outwardly from a bottom surface of the outsole 206 to provide traction and gripping forces when they engage the ground (e.g., turf). A midsole reinforcement structure 210 is attached to the midsole 204 and surrounds an upper portion of the midsole 204 along the heel portion of the midsole 204 with increasing coverage until it covers substantially the entire side surface area of the midsole 204 as it travels from the heel area toward the forefoot area of the midsole 204. In one embodiment, the midsole reinforcement structure 210 is made from a relatively dense ethyl vinyl acetate (EVA) or thermoplastic polyurethane (TPU) material that substantially prevents the respective portions of the midsole 204 covered by the reinforcement structure 210 from collapsing or substantially stretching in an outwardly direction, thereby providing increased strength and stability to the midsole 204.

FIG. 8A further illustrates that the back (right) shoe 200 includes an extended exterior support structure (a.k.a., "extended heel counter") 212 attached to an outer surface of the upper 202 at the rear heel portion of the upper 202 to provide increased strength and support to this area of the shoe 200. This increased strength and support is desirable due to increased forces and outward pressure exerted by the back foot on this area of the upper 202 during the backswing. In one embodiment, the extended heel counter 212 is made from a relatively dense EVA or TPU material that substantially prevents the rear outer portion of the upper from collapsing or substantially stretching in an outwardly direction, thereby providing increased strength and stability to this area of the shoe. In conventional shoes, heel counters are the same shape for both shoes. In accordance with various embodiments of the present invention, the placement, size and shape of the extended heel counter 212 is engineered differently for the front and back shoe to compensate for the different forces and stresses applied to the heel portions of the front and back shoes during a golf swing, thereby providing increased swing efficiency and stability throughout the swing.

As shown in FIGS. 8A and 8B, the upper 202 further includes a saddle 214 that is attached to a middle portion of the shoe 200 and extends from a closure portion 216 to the reinforcement structure 210 on both the medial and lateral sides of the upper 202. The saddle 214 may be made from various known materials or combination of materials and implemented in various configurations (e.g., size, shape, thickness, etc.). The closure portion 216 includes a tongue 218 and a shoe lace 220 to tighten and secure the closure 216 around a top portion of a wearer's foot. The saddle 214 reinforces the middle portion of the upper 202 and provides enhance support and stability to this area of the shoe 202. In various embodiments, the saddle 214 may be made from various materials known in the art, such as TPU, rubber, leather, synthetic leather, textiles, and PU, for example, or any combination of these materials to achieve desired strength, reinforcement and/or flexibility properties.

FIG. 8B illustrates a perspective side medial view of the back (in this case, right) shoe 200. FIG. 8B shows many of the same elements shown in FIG. 8A, many of which need not be further discussed again. There are, however, some differences between the medial side of the back shoe 200 when compared to the lateral side of the back shoe 200. For example, the structure of the heel counter 212 on the medial side is different from the structure on the lateral side. In one embodiment, as shown in FIG. 8B when compared to FIG. 8A, the heel counter structure 212 on the medial side is not "extended and, hence, provides less rigidity and support to this area of the upper 202 when compared to the corresponding heel area on the lateral side of the upper 202. This is because less forces are exerted on the heel area on the medial side of the back shoe 200 during the golf swing when compared to the heel area of the lateral side. Furthermore, by decreasing the amount of material used for the heel counter 212 on the medial side, the invention decreases the overall weight of the shoe while providing adequate support without undue rigidity to this portion of the upper 202.

Additionally, the respective designs and shapes of the midsole 204, outsole 206 and midsole reinforcement structure 210 is different on the medial side, as shown in FIG. 8B, compared to the corresponding structures on the lateral side, as shown in FIG. 8A. In one embodiment, the midsole reinforcement structure 210 is larger in size and comprises more material (e.g., EVA) on the lateral side of the shoe 200 than on the medial side of the shoe 200. A stronger midsole reinforcement structure 210 on the lateral side promotes increase support on the lateral side, while a weaker midsole reinforcement structure 210 on the medial side promotes a smooth transition between various backswing and beginning of the forward-swing stages of the golf swing.

Figure 9A:
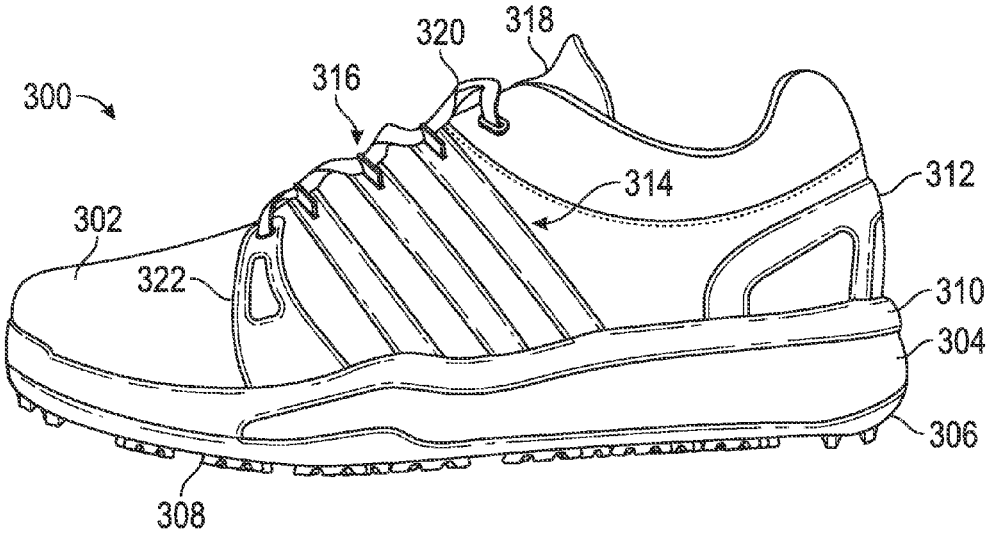
FIGS. 9A and 9B illustrate perspective side views, lateral (outer-step) and medial (in-step) views, respectively, of a front (left) shoe, in accordance with one embodiment of the invention.
Figure 9B:
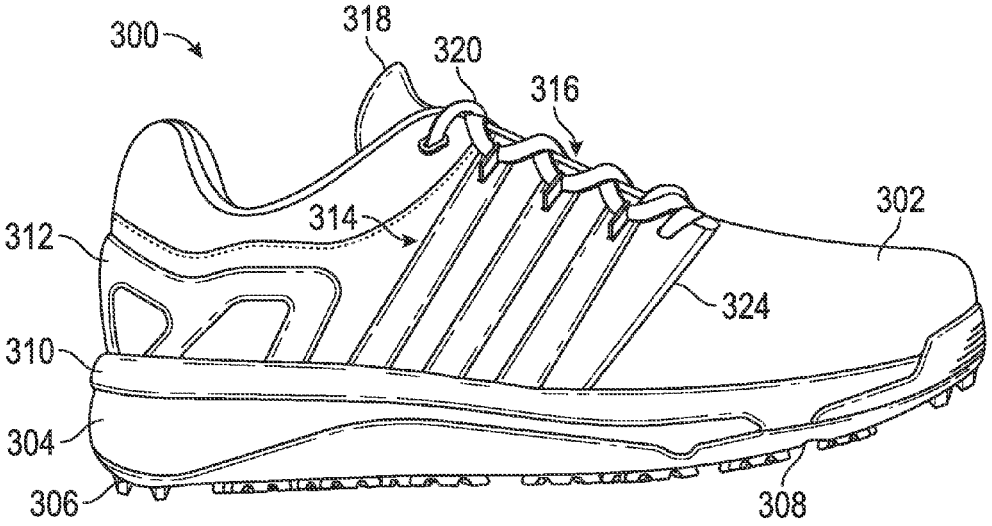

FIGS. 9A and 9B illustrate perspective side lateral and medial views, respectively, of the front (in this case, left) shoe 300, in accordance with one embodiment of the invention. The front shoe 300 includes an upper 302 a midsole 304 attached to a bottom portion of the upper 302 and an outsole 306 attached to the midsole 304 such that the midsole 304 is sandwiched between the upper 302 and the outsole 306. A plurality of traction elements 308 extend outwardly from a bottom surface of the outsole 306 to provide traction and gripping forces when they engage the ground (e.g., turf). A midsole reinforcement structure 310 is attached to the midsole 304 and surrounds an upper portion of the midsole 304 along the heel portion of the midsole 304 with increasing coverage until it covers substantially the entire side surface area of the midsole 304 as it travels from the heel area toward the forefoot area of the midsole 304. In one embodiment, the midsole reinforcement structure 310 is made from a relatively dense EVA or TPU material that substantially prevents the respective portions of the midsole 304 covered by the reinforcement structure 310 from collapsing or substantially stretching in an outwardly direction, thereby providing increased strength and stability to the midsole 304.

FIG. 9A further illustrates that the front shoe 300 includes an exterior support structure (aka, "heel counter") 312 attached to an outer surface of the upper 302 at the rear heel portion of the upper 302 to provide additional support to this area of the shoe 300 without making the shoe too rigid in this area. On the lateral side of the front shoe 300, the heel counter 312 is not extended, whereas on the medial side of shoe 300, the heel counter 312 is extended to provide extra support and strength on the medial heel portion of the upper 302. Note, this is the opposite configuration of the heel counter 212, with respect to the medial and lateral heel areas of the back shoe 200, discussed above with respect to FIGS. 8A and 8B. In one embodiment, the heel counter 312 is made from a relatively dense EVA or TPU material that substantially prevents the rear outer portion of the upper 302 from collapsing or substantially stretching in an outwardly direction, thereby providing increased strength and stability to this area of the shoe.

As shown in FIGS. 9A and 9B, the upper 302 further includes a saddle 314 that is attached to a middle portion of the shoe 300 and extends from a closure portion 316 to the reinforcement structure 310 on both the medial and lateral sides of the upper 302. The closure portion 316 includes a tongue 318 and a shoe lace 320 to tighten and secure the closure 316 around a top portion of a wearer's foot. The saddle 314 reinforces the middle portion of the upper 302 and provides enhanced support and stability to this area of the upper 302. In one embodiment, the saddle 314 on the lateral side of the upper 302 flanges out wider, when compared to the saddle 214 of the back shoe 200, as it meets the upper part of the midsole 304. Alternatively, or additionally, the size (e.g., length, width, thickness) and material properties of the saddle 314 can be altered as desired to provide desired stability and/or flexibility properties. The enhanced flexibility and support provided in this area of the front shoe upper 302 provides improved comfort and stability during the finishing stages of the golf swing, for example. In various embodiments, the saddle 314 may be made from various materials known in the art, such as TPU, rubber, leather, synthetic leather, textiles, and PU, for example, or any combination of these materials to achieve desired strength, reinforcement and/or flexibility properties.

As further shown in FIG. 9A, in one embodiment, the front shoe 300 further includes an "energy sling" 322 attached to the forefoot portion of the upper 302. In one embodiment, the energy sling 322 is designed to allow for stabilized stretching and dampening of forces exerted outwardly in that area of the upper during the finishing stages of the golf swing. In one embodiment, the leather underneath the energy sling 322 is thinner than other portions of the upper 302 to facilitate stretching of the upper 302 in this area during the finishing stages of the swing. The energy sling is made from a flexible, stretchy material that substantially rebounds to its original state to provide enhanced strength, support and a dampening force as the front foot presses into this area of the upper 302 during the finishing stages of the swing. In one embodiment, the energy sling is made from a rigid thermoset polyurethane (RPU).

FIG. 9B illustrates a perspective side medial view of the front (in this case, right) shoe 300. FIG. 9B shows many of the same elements shown in FIG. 9A, many of which need not be further discussed again. It is worth pointing out, however some of the difference between the medial side of the front shoe 300 when compared to the lateral side of the front shoe 300. For example, the structure of the heel counter 312 on the medial side is different from the structure on the lateral side. In one embodiment, comparing FIG. 9B with FIG. 9A, the heel counter structure 312 on the medial side is extended and, hence, provides increased rigidity, strength and support to this area of the upper 302 when compared to the corresponding heel area on the lateral side. This increased strength and support is desirable due to increased forces and outward pressure exerted by the front foot on this area of the upper 302 during the backswing. Thus, more forces are exerted on the heel area on the medial side of the front shoe 300 during the golf swing when compared to the heel area on the lateral side. Furthermore, by decreasing the amount of material used for the heel counter 312 on the lateral side, the invention decreases the overall weight of the shoe 300 while providing adequate support but not undue rigidity to the heel portion of the upper 302 on the lateral side. In one embodiment, the configuration and design of the heel counter 312 for the front shoe 300 is the opposite of the configuration and design of the heel counter 212 for the back shoe 200, as described above with respect to FIGS. 8A and 8B. This is because the front and back feet move differently, exerting different vertical and horizontal forces on the front and back shoes 300 and 200, respectively, during a golf swing, as discussed above.

Comparing FIGS. 9A and 9B further reveals that the energy sling 322 is stronger the lateral (i.e., outer) side of the upper 302 (FIG. 9A) while a weaker version of the energy sling 324 is provided on the medial side of the upper (FIG. 9B). In one embodiment, the energy sling 322 is made from a rubber material with a TPU material glued onto or bonded to the rubber material on the lateral side, while no TPU material is attached to the rubber material on the medial side. In alternative embodiments, no energy sling is provided on the medial side of upper 302. The energy slings 322 and 324 (optional) provides increased support to the upper 302 at impact and follow-through without making the upper too rigid and uncomfortable for the wearer. In one embodiment, working in conjunction with the saddle 314, the energy slings 322 and 324 provide increased upper stability while promoting smoother energy transfer during the golf swing, and increased fit and comfort during normal walking.

Figure 10:
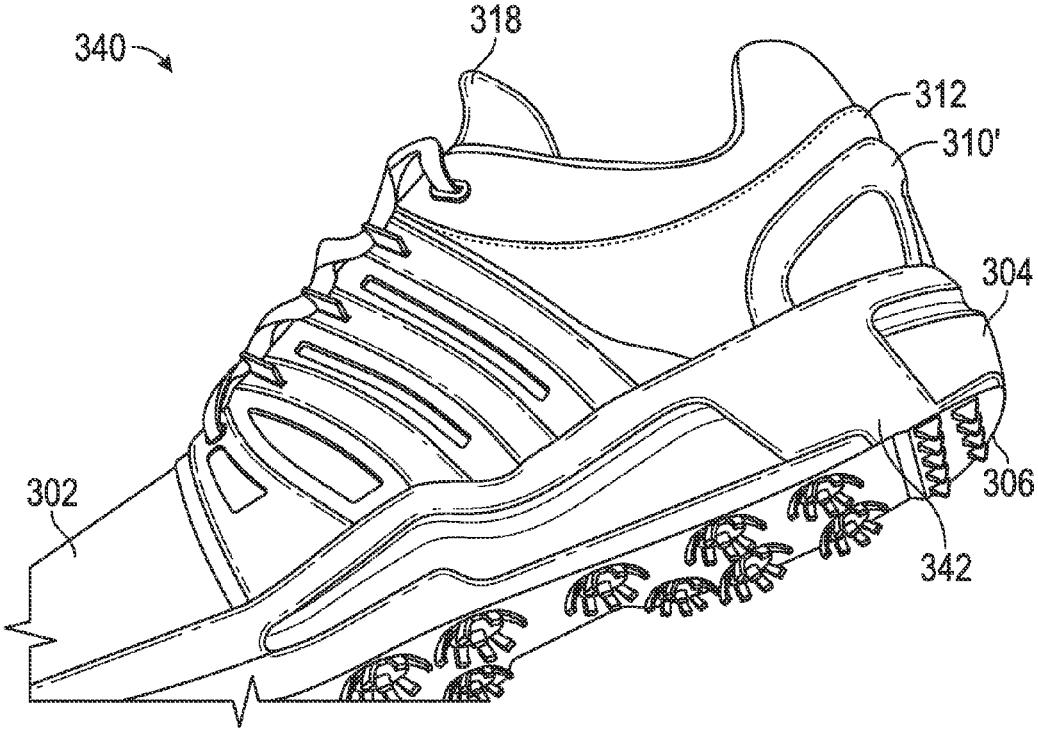
FIG. 10 illustrates a perspective side lateral view of a golfer's front (left) shoe, in accordance with one embodiment of the invention.

FIG. 10 illustrates a perspective side lateral view of the front shoe 340, in accordance with a further embodiment of the invention. The front shoe 340 of FIG. 10 contains the same features and elements as the front shoe 300 shown and discussed above with respect to FIGS. 9A and 9B, but includes an additional support bridge 342 extending from a heel portion of the midsole reinforcement structure 310' to a heel portion of the outsole 306. The additional support bridge 342 further reinforces and supports the lateral heel portion of the midsole 304 to prevent undue compression and/or deformation of the midsole 304 in this region during the various stages of the golf swing, especially the finishing stages.

In one embodiment, the midsole 304 is made from a Boost™ foam material, which is described in further detail below. As illustrated in FIG. 10, additional support structures can be embedded or attached to the midsole 304 Boost™ foam material in strategic areas based on the needs of the left and right foot to provide an additional "bridge" of support during the swing, in accordance with one embodiment of the invention. Thus, in addition to the Boost™ foam material, various portions of the midsole layer can be formed from an alternative material that provides greater stiffness, rigidity, or other desired properties to change the dynamic and/or rebound properties of the sole. In further embodiments, the shape of the Boost™ foam can be different for the left and right foot to promote a desired level of cushioning, footwork and/or stability required for each shoe during a swing.

Figure 11B:
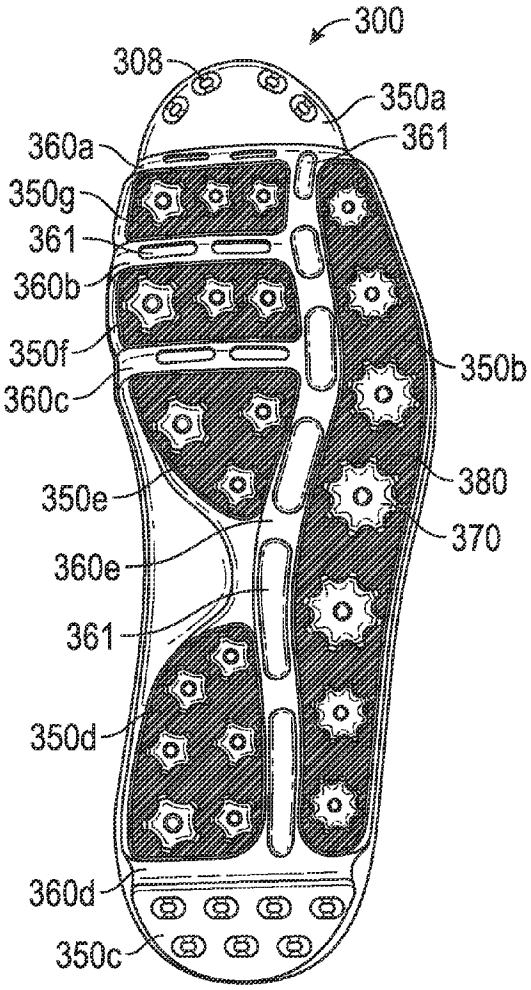
FIGS. 11A and 11B illustrate perspective bottom views of back (right) and front (left) soles, respectively, of a golfer's asymmetric shoes, in accordance with one embodiment of the invention.
Figure 11A:
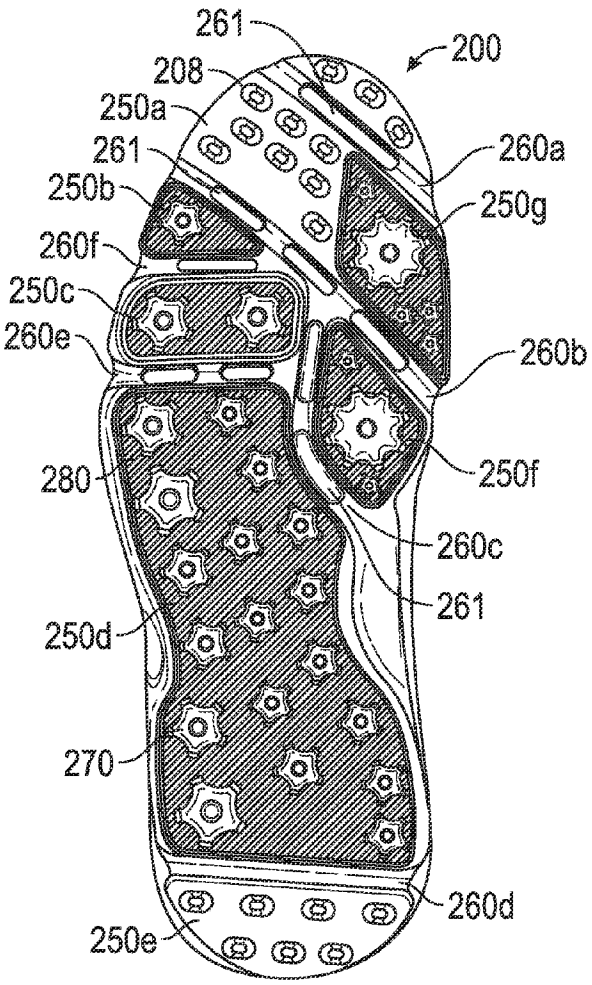

FIGS. 11A and 11B illustrate perspective views of the bottom surfaces of outsoles 208 and 308 of back and front shoes 200 and 300, respectively, in accordance with one embodiment of the invention. Comparing FIGS. 11A and 11B, the outsoles 208 and 308 have different asymmetric configurations, features and traction elements when compared to one another to compensate for the different forces and stresses applied to each shoe, and facilitate the different movements of the back and front feet during the golf swing, thereby optimizing the performance and traction of each shoe during the golf swing. In particular, the number, placement, size and/or shape of the traction elements may be different between the back and front outsoles 208 and 308. Additionally, the number, placement, size and shape of grooves or channels used to facilitate bending of the respective outsoles 208 and 308 are different between the outsoles 208 and 308.

Referring to FIG. 11A, the outsole 208 of the back shoe 200 includes seven traction zones 250*a*, 250*b*, 250*c*, 250*d*, 250*e*, 250*f* and 250*g* separated from one another by six channels or grooves 260*a*, 260*b*, 260*c*, 260*d*, 260*e* and 260*f*. Each traction zone contains one or more traction elements 270 extending outwardly from a bottom surface of the traction zone. In one embodiment, the traction elements 270 of a plurality of the traction zones, e.g., zones 250*b*, 250*c*, 250*d*, 250*f* and 250*g*, may be star-shaped cleat elements of various sizes and configurations, while in some traction zones, e.g., zones 250*a* and 250*e*, the traction elements may be square or triangular-shaped cleat elements, as shown in FIG. 11A. Various different configurations, sizes and shapes of cleat elements may be utilized in different traction zones to achieve desired traction characteristics in accordance with various embodiments of the invention.

In one embodiment, at least some of the traction zones, e.g., zones 250*b*, 250*c*, 250*d*, 250*f* and 250*g*, are formed using GripMore™ technology, in which a plurality of cleat and/or traction elements 270 may be attached to a bottom surface of a flexible fiber cloth or mesh textile lining 280 that is cut and shaped to match the size and shape of each corresponding traction zone. In one embodiment, the fiber cloth or mesh lining 280 is fixedly adhered to a correspondingly sized and shaped indented bottom surface of the outsole 208 corresponding to each respective traction zone. The GripMore™ technology is described in further detail below. The outsole 208 further includes an arch support region where no traction elements are present.

In one embodiment, the traction zone 250*d* is the largest traction zone and contains the majority of the traction elements 270. As shown in FIG. 11A, the traction elements 270 in traction zone 250*c*, and at least some of the traction elements 270 along the lateral edge portions of traction zone 250*d* are larger in size than the traction elements 270 in zones 250*a*, 250*b*, and zone 250*d* closer to the medial portion of zone 250*d*. The larger traction elements 270 provide increased gripping strength when in contact with a playing surface (e.g., turf) for increased traction in the corresponding locations of the outsole 208. During the backswing stages of the golf swing, the traction elements 270 in the traction zones 250*b*, 250*c* and 250*d* play a predominant role in providing traction and stability to the golfer because the majority of vertical and horizontal forces are concentrated in these zones.

The traction zones 250*f* and 250*g*, generally corresponding to the ball and big toe locations of the right foot, each contain a single large traction element 270 that are the largest of the traction elements on the outsole 208. The large traction elements 270 in traction zones 250*f* and 250*g* provide extra gripping strength during impact and the subsequent finishing stages of the golf swing when the right heel raises above the ground and only the ball and/or toe regions of the back shoe remain in contact with the ground. During impact and the finishing stage of the swing, the larger size of the traction elements 270 in zones 250*f* and 250*g* increase the stability of the golfer by providing increased traction where the majority of vertical and horizontal forces will be concentrated. Thus, the traction zones 250*f* and 250*g* enhance traction and stability during the impact and follow-through stages of the swing, in accordance with one embodiment of the invention.

The six grooves 260*a*, 260*b*, 260*c*, 260*d*, 260*e* and 260*f* allow for and facilitate bending of the outsole 208 along each of the respective grooves during various stages of the golf swing, and during walking, to further optimize performance and comfort of the back shoe. The diagonal grooves 260*a*, 260*b* and 260*c* in the toe and forefoot regions of the outsole 208 allow for increased bending and flexibility along the grooves to facilitate the finishing move of the back heel raising onto the ball and big toe of the back foot, as discussed above. Additionally, the transverse grooves 260*e* and 260*f*, working in conjunction with diagonal grooves 260*a*, 260*b*, and 260*c* further increase the comfort of the shoe 200 during walking by increasing the flexibility of the outsole 208 along the respective grooves to provide a larger and more natural range of motion for the back foot either during the golf swing or during normal walking. The transverse groove 260*d* in the heel area of the outsole 208 allows for bending and flexing along the groove 260*d* that provides a "crash pad" for walking and allows for a smoother transition as the heel first touches the ground and thereafter the forefoot portions touch the ground during a normal stepping action. The configurations and dimensions of the various grooves 260*a*-260*f* may be varied to achieve different desired flexibility properties. In one embodiment, the grooves may be 4 to 6 millimeters (mm) in width, and 1 to 3 mm in depth. In a further embodiment some or all of the grooves 260*a*-260*f* may have one or more cut-out portions 261, in which portions of the material forming each groove (e.g., TPU) are removed to expose the underlying midsole material (e.g., Boost™ foam). The cut-out portions 261 facilitate further flexibility and bending along the grooves 260*a*-260*f* in similar fashion to how perforations in a piece of paper allow the piece of paper to bend more easily along the perforations.

Referring to FIG. 11B, the outsole 308 of the front shoe 300 includes seven traction zones 350*a*, 350*b*, 350*c*, 350*d*, 350*e*, 350*f* and 350*g* separated from one another by five channels or grooves 360*a*, 360*b*, 360*c*, 360*d* and 360*e*. Each traction zone contains one or more traction elements 370 extending outwardly from a bottom surface of the traction zone. In one embodiment, the traction elements 370 of a plurality of the traction zones, e.g., zones 350*b*, 350*d*, 350*e*, 350*f* and 350*g*, may be star-shaped cleat elements of various sizes and configurations, while in some traction zones, e.g., zones 350*a* and 350*c*, the traction elements may be square or triangular-shaped cleat elements, as shown in FIG. 11B. Various different configurations, sizes and shapes of cleat elements may be utilized in different traction zones to achieve desired traction characteristics in accordance with various embodiments of the invention.

In one embodiment, at least some of the traction zones, e.g., 350*b*, 350*d*, 350*e*, 350*f* and 350*g*, are formed using GripMore™ technology, in which a plurality of cleat and/or traction elements 270 may be attached to a bottom surface of a flexible fiber cloth or mesh textile lining 280 that is cut and shaped to match the size and shape of each corresponding traction zone. In one embodiment, the fiber cloth or mesh lining 380 is fixedly adhered to a correspondingly sized and shaped indented bottom surface of the outsole 308 corresponding to each respective traction zone. The GripMore™ technology is described in further detail below.

In one embodiment, the traction zone 350*b* along a longitudinal lateral region of the outsole 308 is the largest traction zone of the outsole 308 of the front shoe 300. As shown in FIG. 11B, the traction elements 370 in traction zone 350*b* along the lateral edge portions of the outsole 308 are larger in size than the traction elements 370 in other zones closer to the medial portion of the outsole 308. The larger traction elements 370 provide increased gripping strength when in contact with a playing surface (e.g., turf) for increased traction in the corresponding locations of the outsole 308. During impact and the finishing stages of the golf swing, the traction elements 370 in traction zone 350*b* play a predominant role in providing traction and stability to the golfer because the majority of vertical and horizontal forces are concentrated in this lateral zone of the front shoe 300, as discussed above. In one embodiment, the traction zone 350*b* spans substantially from the toe portion to the heel portion of the outsole 308, along the lateral (i.e., outer) peripheral area of the outsole 308, and is configured to provide enhanced gripping action and traction on the ground during the finishing stages of the swing.

The traction zones 350*d*, 350*e*, 350*f* and 350*g*, corresponding to the medial portions of the outsole 308 play more significant roles during the backswing stages of the swing since the majority of the vertical and horizontal forces will be concentrated in these zones of the front outsole 308 compared to zone 350*b* of the front outsole 308. However, as discussed above, during the backswing stages of the swing, the majority of vertical and horizontal forces are exerted on the outsole 208 of the back shoe 200 which must provide a greater level of traction than the outsole 308 of the front shoe 300.

The five grooves 360*a*, 360*b*, 360*c*, 360*d* and 360*e* allow for and facilitate bending of the outsole 308 along each of the respective grooves during various stages of the golf swing, and during walking, to further optimize performance and comfort of the front shoe 300. The grooves 360*a*, 360*b*, and 360*c* in the toe and forefoot regions of the outsole 308 allow for increased bending and flexibility along the grooves, thereby increasing the comfort of the shoe 300 during walking by providing a larger and more natural range of motion for the front foot either during the golf swing or during normal walking. The transverse groove 360*d* in the heel area of the outsole 308 allows for bending and flexing along the groove 306*d* that provides a "crash pad" for walking and allows for a smoother transition as the heel first touches the ground and thereafter the forefoot portions touch the ground during a normal stepping action. In one embodiment, the grooves 360*a*, 360*b*, 360*c* and 360*d* may be 4 to 6 mm in width, and 1 to 3 mm in depth.

As shown in FIG. 11B, longitudinal groove 360*e* is the longest and largest of the grooves on outsole 308, in accordance with one embodiment of the invention. In one embodiment, the groove 360*e* runs substantially along the entire length from a toe region of the outsole 308 to a heel region of the outsole 308. As discussed above, during the finishing stages of the golf swing, a majority of the golfer's weight will shift to lateral region of the front foot corresponding to the traction zone 350*b*. This causes a majority of vertical and horizontal lateral forces to be concentrated in the traction zone 350*b* causing a "rolling" action from a medial portion of the outsole 308 to the lateral portion of the outsole 308, where traction zone 350*b* is located. The longitudinal groove 360*e* increases the flexibility along the border of the medial region and the lateral region of the outsole 308, thereby facilitating a smoother rolling action and smoother transitions between the backswing, forward swing and follow-through stages of the golf swing. Smoother transitions between these various stages of the swing results in increased balance, less energy loss and, hence, increased power during the golf swing. In one embodiment, the longitudinal groove 360*e* may be 2 to 15 mm in width and, preferably, 4 to 10 mm in width, 0.5 to 6 mm in depth and, preferably, 1 to 3 mm in depth, and extends 60% to 100% and, preferably, 70% to 95% of the entire length of the outsole 308. In a further embodiment some or all of the grooves 360*a*-360*e* may have one or more cut-out portions 361, in which portions of the material forming each groove (e.g., TPU) are removed to expose the underlying midsole material (e.g., Boost™ foam). The cut-out portions 361 facilitate further flexibility and bending along the grooves 360*a*-360*e* in similar fashion to how perforations in a piece of paper allow the piece of paper to bend more easily along the perforations.

The various elements of the asymmetric shoes of the present invention can be made from known suitable materials to achieve desired performance, durability and comfort characteristics. For example, in one embodiment the upper portions 202 and 302 of the back and front shoes 200 and 300, respectively, may be made from a breathable microfiber leather, or similar material, with varying thicknesses in various portions of the upper to achieve desired characteristics and properties. As another example, in one embodiment, the midsoles 204 and 304 discussed above can be made from an expanded TPU (eTPU) material (aka, Boost™ foam). eTPU and other foams based on thermoplastic polyurethanes (TPU) suitable for use to form the midsole and/or outsole layers, in accordance with various embodiments, are described in further detail in U.S. Pat. App. Pub. No. 2010/0222442 A1, which is incorporated by reference herein in its entirety. Additionally, exemplary methods for production of eTPU using water as a blowing agent or propellant are described in U.S. Pat. App. Pub. No. 2012/0065285 A1, which is incorporated by reference herein in its entirety. In some embodiments, the midsole layer can comprise a hybrid material comprising a matrix of PU and foamed particles of TPU or other thermoplastic elastomers, as described in U.S. Pat. App. Pub. No. 2010/0047550 A1, which is incorporated by reference herein in its entirety.

Some exemplary advantages of using Boost™ foam as a midsole material is that it is light weight and possesses superior energy-return or rebound properties that promote smooth energy transfer during the swing. The Boost™ foam also results in a lighter weight shoe, which further reduces fatigue to the wearer, especially if he or she is walking a golf course. The Boost™ foam also provides consistent and responsive cushioning across dynamic temperature ranges from subzero cold to punishing heat, thereby retaining its advantageous properties in any weather.

In one embodiment, the outsoles 206 and 306 discussed above may be made from an EVA or TPU material, and can be injection molded with one or more types of thermoplastic polyurethane (TPU), wherein the midsoles 204 and 304 can be formed by pouring Boost™ foam material into respective TPU molds of the outsoles 206 and 306. Thus, the soles described herein, comprising midsole and outsole layers, can provide increased comfort and performance compared to conventional golf shoe soles having a single rigid platform that spans the sole and supports the traction elements in a dependent manner. The poured midsole can provide a durable yet soft and comfortable region below the golfer's foot and can bond directly to the injection molded outsole without cement or other rigid adhesion materials. The lower outsole can comprise a durable yet flexible material and can include various traction elements supported independently from one another such that they can flex and move separately throughout the golf swing, which results in more of the traction elements being in contact with the ground at any given time and can allow the golfer's foot to have more freedom of motion and more comfort. Additionally, the soles described herein can be lighter than conventional soles due to the use of lightweight polymeric materials, direct bonding of the constituent materials without cement, lack of other conventional platform components, and other properties.

In other embodiments, the asymmetric golf shoe sole includes an outsole made of TPU and having a lower traction surface, and a midsole made of PU or eTPU and bonded to an upper surface of the outsole for supporting a golfer's foot. The outsole can comprise a first TPU material having a first hardness and a second TPU material having a second hardness that is less than the first hardness. The first TPU material can comprise a curved band that extends from a toe end of the outsole, along a lateral side of a forefoot region of the outsole, across an arch portion of the outsole, along a medial side of the outsole, and toward a heel end of the outsole. The outsole can further comprise an upper rim defining a recessed region along the upper side of the outsole such that the midsole fills the recessed region. In one embodiment, the midsole can be bonded directly to the outsole without an intermediate adhesive material. The midsole can comprise various foams and hybrid materials, such as a matrix of PU and foamed particles of TPU or eTPU. Various soles and methods of making soles may be utilized in accordance with the present invention, such as those described in U.S. Provisional Application Ser. No. 61/896,442 filed on Oct. 28, 2013, which is incorporated by reference herein in its entirety. It should be noted that in U.S. Provisional Application Ser. No. 61/896,442 what is referred to as the "midsole" herein is referred to as the "upper outsole." In further embodiments, the soles of the asymmetric shoes may be made from various material layers as described in U.S. Publication No. 2013/0291409 A1, the entirety of which is incorporated by reference herein.

Although various embodiments described above focus on the use of Boost™ foam material for the midsole, other embodiments of the invention are not limited to using a particular type of material for the midsole, which can be made from any other suitable material such as TPU, Rubber, EVA, etc., or combination of such materials.

In one embodiment, the traction zones and traction elements discussed above with respect to FIGS. 11A and 11B can be made using GripMore™ technology, in which a plurality of cleat and/or traction elements may be attached to a bottom surface of a flexible fiber cloth or mesh textile lining. In one embodiment, multiple durometer plastic cleats are injected into the fiber cloth so as to be permanently held in place by means of known techniques. For example, the cleats which can be made of a highly durable TPR (thermoplastic rubber) are injected onto a lightweight but strong mesh textile lining and affixed with commercial grade adhesives for a secure bond. The mesh backing with injected cleats is then set into a pre-defined area in the outsole (commonly TPU) and glued in place to form the traction elements needed as per the sporting activity requirements.

In various embodiments, the flexible fiber cloth or mesh lining can be made from known plastics, rubber or other flexible, durable materials, or any combination of such materials. In various embodiments, the cleats or traction elements can be made from suitable polyurethane (PU) materials. The flexible fiber cloth can be cut and shaped to be attached to premade indentations in the bottom surface of the outsole. The flexible fiber cloth can be permanently attached to the bottom surface of the outsole by any suitable means, such as gluing, bonding, etc. The Gripmore™ technology is described in further detail in Taiwan Publication No. TW M412636U1, the entirety of which is incorporated by reference herein.

The Gripmore™ cleat technology provides many advantages for shoes requiring cleats. The fiber cloth can be ideally shaped, preformed and placed as desired without restriction to provide any cleat or traction element configuration. Additionally, since conventional cleat receptacle structures for receiving and securing a cleat therein are no longer required, the manufacturing cost and weight of the golf shoes are significantly decreased. Further, since cleat receptacle structures are no longer required, the size and placement of cleats on the bottom surface of the outsole are no longer limited by available space for the receptacle structures in the midsole layer.

Figure 12A:
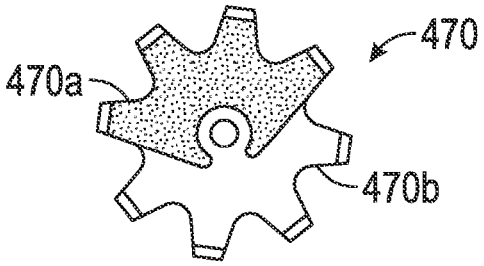
FIGS. 12A and 12B illustrate perspective views of a traction element and exemplary placement of such traction elements on an outsole, in accordance with one embodiment of the invention.

In one embodiment, the traction elements 270 and/or 370 of FIGS. 11A and 11B, respectively, may be replaced by one or more traction elements 470 having two different sections 470*a* and 470*b*, as shown in FIG. 12A. In one embodiment, the two different sections 470*a* and 470*b* have different flex or elastic properties, as indicated by the shaded portion 470*a* and unshaded portion 470*b* of the traction element (e.g., cleat) 470. In one embodiment, the shaded portion 470*a* is more flexible than the unshaded portion 470*b* to provide greater gripping action with turf and hence better traction during the golf swing. The unshaded portion 470*b* of the traction element 470 is more rigid which provides better durability to the traction elements 470 during walking, for example.

Figure 12B:
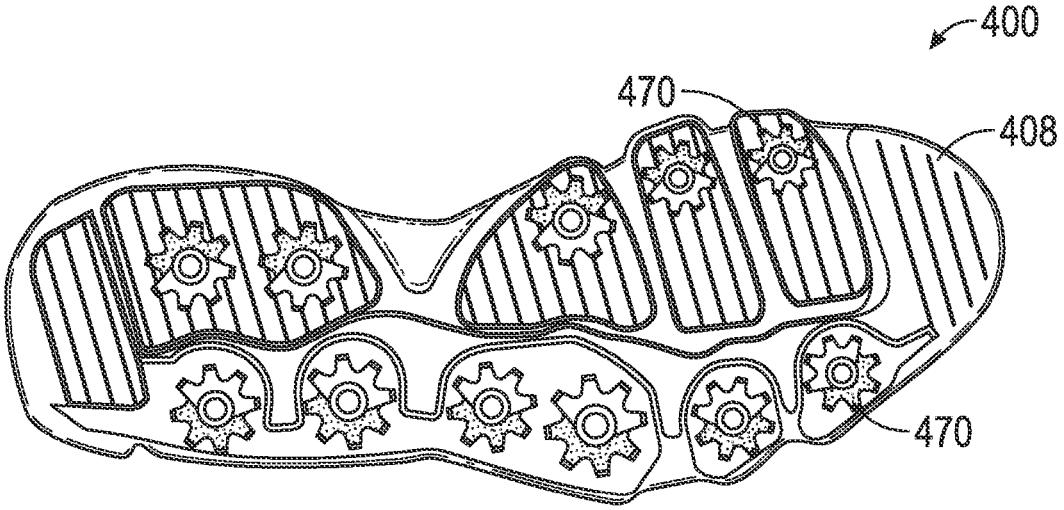

As shown in FIG. 12B, an alternative embodiment of a front shoe 400 includes an outsole 408 having traction elements 470 attached thereto. In one embodiment, the more flexible sections 470*a* of each traction element 470 can generally be located nearer to the outer peripheral edges of the outsole 408 when compared to the more rigid sections 470*b* of the traction elements 470. Thus, the traction elements 470 provide a balance of improved traction and durability to the asymmetric golf shoes in accordance with various embodiments of the invention. In alternative embodiments, the traction elements 470 can have three or more different sections each having different flexibility or other mechanical properties to achieve different levels of traction, durability and/or other performance characteristics. The traction elements can be made from injection molding processes and/or other processes known in the art. In one embodiment, the traction elements 470 having two or more sections as discussed above are permanently attached to a flexible fiber cloth as discussed above in connection with the Gripmore™ technology. In alternative embodiments, such traction elements may be attached to a bottom surface of an outsole by means of conventional cleat receptacle and securement structures.

Various exemplary embodiments of the asymmetric pair of shoes of the present invention have been described above wherein the uppers of each shoe have unique support features (e.g., enhanced support zones, energy sling, offset closure, modified heel counters, saddles, etc.) configured to provide increased support to respective areas of each respective upper, and which are not present at corresponding mirror-image locations of the other upper. Furthermore, the soles of each shoe in the asymmetric pair have unique traction features (e.g., traction zones, traction zone configurations, traction elements, grooves, etc.) configured to provide increase traction to respective areas of each respective sole, and which are not present at corresponding mirror-image locations of the other sole. As discussed above, in accordance with various embodiments of the invention as it may be applied to the game of golf, the upper portions and sole portions of the front and back shoes have asymmetric support features and traction features, respectively to compensate for the different forces and stresses applied to the front and back shoes during a golf swing, thereby optimizing the performance of each shoe and facilitating the different movements of the back and front feet during the golf swing.

While various embodiments of the invention have been described above, it should be understood that they have been presented by way of example only, and not by way of limitation. Likewise, the various figures or diagrams presented depict an example design, structure or configuration, which is done to aid in understanding the concepts, features and functionality that can be included in various shoe pairs in accordance with one or more embodiments of the invention. The invention is not restricted to the illustrated exemplary designs, structures or configurations, but can be implemented using a variety of alternative designs, structures and configurations depending on the particular sporting activity (e.g., golf, baseball, track and field, etc.) or performance characteristics desired for a particular application.

Additionally, it should be understood that the various features and functionality described in one or more of the individual embodiments are not limited in their applicability to the particular embodiment with which they are described, but instead can be applied, alone or in some combination, to one or more of the other embodiments of the invention, whether or not such embodiments are explicitly described and whether or not such features are presented as being a part of a particular described embodiment. Thus, the breadth and scope of the present invention should not be limited by any of the above-described exemplary embodiments but should be accorded a scope commensurate with the claims presented herein.

What is claimed is:

1. An asymmetric pair of shoes, comprising: a first shoe having a first upper and a first sole attached to the first upper, wherein the first upper comprises a first support feature configured to provide increased support to at least one portion of the first upper during performance of a first predetermined action of a first foot of a wearer, and the first sole comprises a first traction feature configured to provide increased traction to at least one portion of the first sole during performance of the first predetermined action of the first foot; and a second shoe having a second upper and a second sole attached to the second upper, wherein the first support feature and first traction feature are not present at corresponding mirror-image locations of the second shoe, wherein the first support feature comprises a first enhanced support zone located at a lateral middle to forefoot area of the first upper, and the first enhanced support zone provides greater support and flexibility to a lateral middle to forefoot area of the first upper compared to other areas of the first upper, wherein the first sole comprises a first outsole, a first midsole and first midsole reinforcement structure, and the second sole comprises a second outsole, a second midsole and second midsole reinforcement structure, the first midsole reinforcement structure is attached to the first midsole between the first midsole and the first upper and surrounds an upper portion of the first midsole along a heel portion of the first midsole with increasing coverage until the first midsole reinforcement structure covers substantially an entire side surface area of the first midsole in a forefoot area of the first midsole, and wherein the design and shape of the first midsole reinforcement structure is different on a medial side compared to a lateral side, and the second midsole reinforcement structure is attached to the second midsole between the second midsole and the second upper and surrounds an upper portion of the second midsole along a heel portion of the second midsole with increasing coverage until the second midsole reinforcement structure covers substantially an entire side surface area of the second midsole in a forefoot area of the second midsole.

2. The asymmetric pair of shoes of claim 1, wherein the first enhanced support zone comprises an energy sling covering a lateral forefoot area of the first upper, wherein the energy sling is made from at least one material that provides increased support to the lateral forefoot area compared to other areas of the first upper while enhancing at least one of a stretch and a rebound characteristic of the lateral forefoot area.

3. The asymmetric pair of shoes of claim 2, wherein the at least one material comprises at least one of rubber and thermoplastic polyurethane.

4. The asymmetric pair of shoes of claim 2, wherein the first enhanced support zone further comprises a first saddle covering a lateral middle area of the first upper, wherein the first saddle is made from at least one material that provides increased strength to the lateral middle area of the first upper to provide increased support to the lateral middle area of the first upper.

5. The asymmetric pair of shoes of claim 1, wherein the first upper further comprises a closure that is offset closer to a medial side of the first upper so as to increase a surface area of the first enhanced support zone.

6. The asymmetric pair of shoes of claim 1, wherein the first traction feature comprises a longitudinal groove on a bottom surface of the first sole that spans substantially the length of the first sole.

7. The asymmetric pair of shoes of claim 6, wherein the longitudinal groove spans at least 75% of the length of the first sole.

8. The asymmetric pair of shoes of claim 6, wherein the longitudinal groove comprises at least one cut-out portion that further facilitates bending along the longitudinal groove.

9. The asymmetric pair of shoes of claim 1, wherein the first support feature comprises a first heel counter located on a heel area of the first upper, wherein a medial portion of the first heel counter located on a medial side of the heel area of the first upper is larger than a lateral portion of the first heel counter located on a lateral side of the heel area of the first upper.

10. The asymmetric pair of shoes of claim 1, wherein the second upper comprises a second support feature configured to provide increased support to at least one portion of the second upper during performance of a second predetermine action of a second foot of the wearer, and the second sole comprises a second traction feature configured to provide increased traction to at least one portion of the second sole during performance of the second predetermined action, wherein the first predetermined action of the first foot is different from the second predetermined action of the second foot, and the second support feature and the second traction feature are not present at corresponding mirror-image locations of the first shoe.

11. The asymmetric pair of shoes of claim 10, wherein the second support feature comprises a second enhanced support zone located at a lateral middle to heel location of the second upper, wherein the second enhanced support zone is stronger and more flexible than other areas of the second upper.

12. The asymmetric pair of shoes of claim 11, wherein the second enhanced support zone comprises a second heel counter located at a heel area of the second upper, wherein a lateral portion of the second heel counter located on a lateral side of the heel area of the second upper is larger than a medial portion of the second heel counter located on a medial side of the heel area of the second upper.

13. The asymmetric pair of shoes of claim 11, wherein the second enhanced support zone further comprises a second saddle covering a lateral middle area of the second upper, wherein the second saddle is made from at least one material that provides increased strength to the lateral middle area of the second upper while enhancing at least one of a stretch and a rebound characteristic of the lateral middle area of the second upper.

14. The asymmetric pair of shoes of claim 10, wherein the second traction feature comprises ball and big toe traction zones configured to generally correspond to a ball and a big toe location of the second foot, each of the ball and big toe traction zones containing a single large traction element larger than traction elements in other traction zones on the second sole.

15. The asymmetric pair of shoes of claim 10, wherein the first traction feature comprises a first configuration of a first plurality of traction zones, the second traction feature comprises a second configuration of a second plurality of traction zones, each of the first and second pluralities of traction zones having at least one traction element extending outwardly from a surface thereof, wherein the first configuration of the first plurality of traction zones is different from a mirror image of the second configuration of the second plurality of traction zones.

16. The asymmetric pair of shoes of claim 15, wherein a flexible lining material is fixedly coupled to each of the first and second plurality of traction zones and the at least one traction element extending outwardly from each of the first and second plurality of traction zones is fixedly coupled to the flexible lining material of each of the first and second plurality of traction zones.

17. The asymmetric pair of shoes of claim 1, wherein a first configuration of the first outsole, first midsole and first midsole reinforcement structure of the first sole is different from a mirror image of a second configuration of the second outsole, second midsole and second midsole reinforcement structure of the second sole.

18. The asymmetric pair of shoes of claim 17, further comprising a support bridge extending from a heel portion of the first midsole reinforcement structure to a heel portion of the first outsole.

19. The asymmetric pair of shoes of claim 17, wherein the first and second midsoles are made from an expanded thermoplastic polyurethane material.

20. The asymmetric pair of shoes of claim 19, wherein the first and second midsole reinforcement structures are made from ethyl vinyl acetate material.

21. An asymmetric pair of golf shoes, comprising: a first shoe having a first upper and a first sole attached to the first upper, wherein the first upper comprises a first support feature configured to provide increased support to at least one portion of the first upper during performance of a forward swing motion of a golf swing, and the first sole comprises a first traction feature configured to provide increased traction to at least one portion of the first sole during performance of the forward swing motion; and a second shoe having a second upper and a second sole attached to the second upper, wherein the second upper comprises a second support feature configured to provide increased support to at least one portion of the second upper during performance of a backswing motion of a golf swing, and the second sole comprises a second traction feature configured to provide increased traction to at least one portion of the second sole during performance of the backswing motion, wherein the first support feature and first traction feature are not present at corresponding mirror-image locations of the second shoe, and the second support feature and the second traction feature are not present at corresponding mirror-image locations of the first shoe, wherein the first support feature comprises a first enhanced support zone located at a lateral middle to forefoot area of the first upper, wherein the first enhanced support zone provides greater support and flexibility to the lateral middle to forefoot area of the first upper compared to other areas of the first upper, wherein the first sole comprises a first outsole, a first midsole and first midsole reinforcement structure, and the second sole comprises a second outsole, a second midsole and second midsole reinforcement structure, the first midsole reinforcement structure is attached to the first midsole between the first midsole and the first upper and surrounds an upper portion of the first midsole along a heel portion of the first midsole with increasing coverage until the first midsole reinforcement structure covers substantially an entire side surface area of the first midsole in a forefoot area of the first midsole, and wherein the design and shape of the first midsole reinforcement structure is different on a medial side compared to a lateral side, and the second midsole reinforcement structure is attached to the second midsole between the second midsole and the second upper and surrounds an upper portion of the second midsole along a heel portion of the second midsole with increasing coverage until the second midsole reinforcement structure covers substantially an entire side surface area of the second midsole in a forefoot area of the second midsole.

22. The asymmetric pair of golf shoes of claim 21, wherein the first enhanced support zone comprises an energy sling covering a lateral forefoot area of the first upper, wherein the energy sling is made from at least one material that provides increased support to the lateral forefoot area compared to other areas of the first upper while enhancing at least one of a stretch and a rebound characteristic of the lateral forefoot area.

23. The asymmetric pair of golf shoes of claim 22, wherein the at least one material comprises at least one of rubber and thermoplastic polyurethane.

24. The asymmetric pair of golf shoes of claim 22, wherein the first enhanced support zone further comprises a first saddle covering a lateral middle area of the first upper, wherein the first saddle is made from at least one material that provides increased strength to the lateral middle area of the first upper to provide increased support to the lateral middle area of the first upper.

25. The asymmetric pair of golf shoes of claim 21, wherein the first upper further comprises at closure that is offset closer to a medial side of the first upper so as to increase a surface area of the first enhanced support zone.

26. The asymmetric pair of golf shoes of claim 21, wherein the first traction feature comprises a longitudinal groove on a bottom surface of the first sole that spans substantially the length of the first sole.

27. The asymmetric pair of golf shoes of claim 26, wherein the longitudinal groove spans at least 75% of the length of the first sole.

28. The asymmetric pair of golf shoes of claim 26, wherein the longitudinal groove includes at least one cut-out portion.

29. The asymmetric pair of golf shoes of claim 21, wherein the first support feature comprises a first heel counter located on a heel area of the first upper, wherein a medial portion of the first heel counter located on a medial side of the heel area of the first upper is larger than a lateral portion of the first heel counter located on a lateral side of the heel area of the first upper.

30. The asymmetric pair of golf shoes of claim 21, wherein the second support feature comprises a second enhanced support zone located at a lateral middle to heel location of the second upper, wherein the second enhanced support zone stronger and more flexible than other areas of the second upper.

31. The asymmetric pair of golf shoes of claim 30, wherein the second enhanced support zone comprises a second heel counter located at a heel area of the second upper, wherein a lateral portion of the second heel counter located on a lateral side of the heel area of the second upper is larger than a medial portion of the second heel counter located on a medial side of the heel area of the second upper.

32. The asymmetric pair of golf shoes of claim 30, wherein the second enhanced support zone further comprises a second saddle covering a lateral middle area of the second upper, wherein the second saddle is made from at least one material that provides increased strength to the lateral middle area of the second upper while enhancing at least one of a stretch and a rebound characteristic of the lateral middle area of the second upper.

33. The asymmetric pair of golf shoes of claim 21, wherein the second traction feature comprises ball and big toe traction zones configured to generally correspond to a ball and a big toe location of the second foot, each of the ball and big toe traction zones containing a single large traction element larger than traction elements in other traction zones on the second sole.

34. The asymmetric pair of golf shoes of claim 21, wherein the first traction feature comprises a first configuration of a first plurality of traction zones, the second traction feature comprises a second configuration of a second plurality of traction zones, each of the first and second pluralities of traction zones having at least one traction element extending outwardly from a surface thereof, wherein the first configuration of the first plurality of traction zones is different from a mirror image of the second configuration of the second plurality of traction zones.

35. The asymmetric pair of golf shoes of claim 34, wherein a flexible lining material is fixedly coupled to each of the first and second plurality of traction zones and the at least one traction element extending outwardly from each of the first and second plurality of traction zones is fixedly coupled to the flexible lining material of each of the first and second plurality of traction zones.

36. The asymmetric pair of golf shoes of claim 34, wherein a plurality of the at least one traction elements extending outwardly from each of the first and second plurality of traction zones each contain at least two different sections having different flex and durability characteristics.

37. The asymmetric pair of golf shoes of claim 21, wherein a first configuration of the first outsole, first midsole and first midsole reinforcement structure of the first sole is different from a mirror image of a second configuration of the second outsole, second midsole and second midsole reinforcement structure of the second sole.

38. The asymmetric pair of golf shoes of claim 37, further comprising a support bridge extending from a heel portion of the first midsole reinforcement structure to a heel portion of the first outsole.

39. The asymmetric pair of golf shoes of claim 37, wherein the first and second midsoles are made from an expanded thermoplastic polyurethane material.

40. The asymmetric pair of golf shoes of claim 39, wherein the first and second midsole reinforcement structures are made from ethyl vinyl acetate material.

41. An asymmetric pair of golf shoes, comprising: a first shoe having a first upper and a first sole attached to the first upper, wherein the first sole comprises at least one first traction feature configured to provide increased traction to at least one portion of the first sole during performance of a predetermined swing motion, wherein the at least one first traction feature comprises a longitudinal groove on a bottom surface of the first sole that spans substantially the entire length of the first sole; and a second shoe having a second upper and a second sole attached to the second upper, wherein the at least one first traction feature is not present at a corresponding mirror-image location on the second sole of the second shoe, wherein the first sole comprises a first outsole, a first midsole and first midsole reinforcement structure, and the second sole comprises a second outsole, a second midsole and second midsole reinforcement structure, the first midsole reinforcement structure is attached to the first midsole between the first midsole and the first upper and surrounds an upper portion of the first midsole along a heel portion of the first midsole with increasing coverage until the first midsole reinforcement structure covers substantially an entire side surface area of the first midsole in a forefoot area of the first midsole, and wherein the design and shape of the first midsole reinforcement structure is different on a medial side compared to a lateral side, and the second midsole reinforcement structure is attached to the second midsole between the second midsole and the second upper and surrounds an upper portion of the second midsole along a heel portion of the second midsole with increasing coverage until the second midsole reinforcement structure covers substantially an entire side surface area of the second midsole in a forefoot area of the second midsole.

42. The asymmetric pair of golf shoes of claim 41, wherein the longitudinal groove spans at least 75% of the length of the first sole.

43. The asymmetric pair of golf shoes of claim 41, wherein the longitudinal groove comprises at least one cut-out portion.

44. The asymmetric pair of golf shoes of claim 41, further comprises at least one second traction feature located on the second sole, which is not present at a corresponding mirror-image location on the first sole of the first shoe, the at least one second traction feature comprising ball and big toe traction zones configured to generally correspond to a ball and a big toe location of the second foot, respectively, each of the ball and big toe traction zones containing a single large traction element larger than traction elements in other traction zones on the second sole.

45. The asymmetric pair of golf shoes of claim 44, wherein the at least one first traction feature further comprises a first configuration of a first plurality of traction zones, the at least one second traction feature comprises a second configuration of a second plurality of traction zones, each of the first and second pluralities of traction zones having at least one traction element extending outwardly from a surface thereof, wherein the first configuration of the first plurality of traction zones is different from a mirror image of the second configuration of the second plurality of traction zones.

46. The asymmetric pair of golf shoes of claim 45, wherein a flexible lining material is fixedly coupled to each of the first and second plurality of traction zones and the at least one traction element extending outwardly from each of the first and second plurality of traction zones is fixedly coupled to the flexible lining material of each of the first and second plurality of traction zones.

47. The asymmetric pair of golf shoes of claim 45, wherein a plurality of the at least one traction elements extending outwardly from each of the first and second plurality of traction zones each contain at least two different sections having different flex and durability characteristics.

48. The asymmetric pair of golf shoes of claim 41, wherein a first configuration of the first outsole, first midsole and first midsole reinforcement structure of the first sole is different from a mirror image of a second configuration of the second outsole, second midsole and second midsole reinforcement structure of the second sole.

49. The asymmetric pair of golf shoes of claim 48, wherein the first and second midsoles are made from an expanded thermoplastic polyurethane material.

50. The asymmetric pair of golf shoes of claim 48, wherein the first and second midsole reinforcement structures are made from ethyl vinyl acetate material.

51. An asymmetric pair of golf shoes, comprising a first shoe having a first upper and a first sole attached to the first upper, wherein the first upper comprises at least one first support feature configured to provide increased support to at least one portion of the first upper during performance of a predetermined swing motion of a golf swing; and a second shoe having a second upper and a second sole attached to the second upper, wherein the at least one first support feature is not present at a corresponding mirror-image location on the second upper, wherein the first support feature comprises a first enhanced support zone located at a lateral middle to forefoot area of the first upper, wherein the first enhanced support zone provides greater support and flexibility to the lateral middle to forefoot area of the first upper compared to other areas of the first upper, wherein the first sole comprises a first outsole, a first midsole and first midsole reinforcement structure, and the second sole comprises a second outsole, a second midsole and second midsole reinforcement structure, the first midsole reinforcement structure is attached to the first midsole between the first midsole and the first upper and surrounds an upper portion of the first midsole along a heel portion of the first midsole with increasing coverage until the first midsole reinforcement structure covers substantially an entire side surface area of the first midsole in a forefoot area of the first midsole, and wherein the design and shape of the first midsole reinforcement structure is different on a medial side compared to a lateral side, and the second midsole reinforcement structure is attached to the second midsole between the second midsole and the second upper and surrounds an upper portion of the second midsole along a heel portion of the second midsole with increasing coverage until the second midsole reinforcement structure covers substantially an entire side surface area of the second midsole in a forefoot area of the second midsole.

52. The asymmetric pair of golf shoes of claim 51, wherein the first enhanced support zone comprises an energy sling covering a lateral forefoot area of the first upper, wherein the energy sling is made from at least one material that provides increased support to the lateral forefoot area compared to other areas of the first upper while enhancing at least one of a stretch and a rebound characteristic of the lateral forefoot area.

53. The asymmetric pair of golf shoes of claim 52, wherein the at least one material comprises at least one of rubber and thermoplastic polyurethane.

54. The asymmetric pair of golf shoes of claim 51, wherein the first enhanced support zone further comprises a first saddle covering a lateral middle area of the first upper, wherein the first saddle is made from at least one material that provides increased strength to the lateral middle area of the first upper to provide increased support to the lateral middle area of the first upper.

55. The asymmetric pair of golf shoes of claim 51, wherein the at least one first support feature further comprises a closure that is offset closer to a medial side of the first upper so as to increase a surface area of the first enhanced support zone.

56. The asymmetric pair of golf shoes of claim 51, wherein the at least one first support feature comprises a first heel counter located on a heel area of the first upper, wherein a medial portion of the first heel counter located on a medial side of the heel area of the first upper is larger than a lateral portion of the first heel counter located on a lateral side of the heel area of the first upper.

57. The asymmetric pair of golf shoes of claim 51, further comprising at least one second support feature located on the second upper that is not present at a corresponding mirror-image location on the first upper, wherein the at least one second support feature comprises a second enhanced support zone located at a lateral middle to heel location of the second upper, wherein the second enhanced support zone is stronger and more flexible than other areas of the second upper.

58. The asymmetric pair of golf shoes of claim 57, wherein the second enhanced support zone comprises a second heel counter located at a heel area of the second upper, wherein a lateral portion of the second heel counter located on a lateral side of the heel area of the second upper is larger than a medial portion of the second heel counter located on a medial side of the heel area of the second upper.

59. The asymmetric pair of golf shoes of claim 57, wherein the second enhanced support zone further comprises a second saddle covering a lateral middle area of the second upper, wherein the second saddle is made from at least one material that provides increased strength to the lateral middle area of the second upper while enhancing at least one of a stretch and a rebound characteristic of the lateral middle area of the second upper.

* * * * *